US008641474B2

(12) United States Patent
Lam

(10) Patent No.: US 8,641,474 B2
(45) Date of Patent: Feb. 4, 2014

(54) TOY PLAY SET

(76) Inventor: Peter Ar-Fu Lam, Torrance, CA (US)

( * ) Notice: Subject to any disclaimer, the term of this patent is extended or adjusted under 35 U.S.C. 154(b) by 2038 days.

(21) Appl. No.: 10/118,706

(22) Filed: Apr. 8, 2002

(65) Prior Publication Data

US 2003/0025504 A1 Feb. 6, 2003

Related U.S. Application Data

(63) Continuation-in-part of application No. 09/896,434, filed on Jun. 29, 2001, now Pat. No. 6,586,942.

(51) Int. Cl.
*A63H 5/00* (2006.01)
*A63H 29/22* (2006.01)

(52) U.S. Cl.
USPC ..... 446/484; 446/397

(58) Field of Classification Search
USPC ..... 446/175, 297, 298, 397, 484
See application file for complete search history.

(56) References Cited

U.S. PATENT DOCUMENTS 2,310,037 A * 2/1943 Reno ..... 446/379
3,949,517 A * 4/1976 Reiner et al. ..... 446/26
4,348,191 A * 9/1982 Lipsitz et al. ..... 434/308
4,571,202 A * 2/1986 Diebold ..... 446/90
4,820,233 A * 4/1989 Weiner ..... 446/303
4,855,662 A * 8/1989 Yang ..... 320/103
4,883,443 A * 11/1989 Chase ..... 446/478
5,285,437 A * 2/1994 Yokota et al. ..... 369/64
5,347,587 A * 9/1994 Takahashi et al. ..... 381/117
5,349,489 A * 9/1994 Schelen ..... 361/77
5,385,344 A * 1/1995 Miller et al. ..... 273/460
5,466,181 A * 11/1995 Bennett et al. ..... 446/297
5,607,336 A * 3/1997 Lebensfeld et al. ..... 446/297
5,864,280 A * 1/1999 Hall ..... 338/22 R
5,906,369 A * 5/1999 Brennan et al. ..... 273/238
6,171,168 B1 * 1/2001 Jessop ..... 446/297
6,227,931 B1 * 5/2001 Shackelford ..... 446/268
6,292,780 B1 * 9/2001 Doederlein et al. ..... 704/270
6,460,851 B1 * 10/2002 Lee et al. ..... 273/238
6,524,159 B1 * 2/2003 Kawarizadeh ..... 446/397
6,641,455 B2 * 11/2003 Chan ..... 446/297
6,719,604 B2 * 4/2004 Chan ..... 446/297

FOREIGN PATENT DOCUMENTS

JP 06096758 A * 4/1994

* cited by examiner

*Primary Examiner* — Gene Kim
*Assistant Examiner* — Alyssa Hylinski

(57) ABSTRACT

A toy play set comprising a master toy member and two or more accessory toy members. The master toy member comprises a power source, an audio driving circuit and an audio transducer. Each of said accessory toy member is configured to receive power from said master toy member by contact and to provide visual response and/or an audio sound through a speaker located at said master toy member.

40 Claims, 14 Drawing Sheets

TOY PLAY SET

This is a Continuation In Part application of U.S. patent application Ser. No. 09/896,434 filed Jun. 29, 2001 now U.S. Pat. No. 6,586,942.

FIELD OF THE INVENTION

The present invention relates to an electronics toy play set.

BACKGROUND OF THE INVENTION

Traditional portable electronics/electrical devices such as electrical tools or toys draw power from the batteries installed inside the devices. The number of batteries required depends on the working voltage specified by the circuit utilized. For many electronics circuits, three batteries are needed to provide a typical working voltage between 3V to 4.5V. The working voltage required by many microcontroller chips is in between 3V to 6V. In order to provide a reasonable working battery life to a device drawing a current over 100 mA, such as the products that comprise a light bulb, motor or speaker, the size of the batteries selected are typically of AA, C or D size batteries. These batteries not only add considerable weight to the device, they limit the ability of the designer to shrink the product size, a feature that is highly desirable for miniature toys. It is the objective of this invention to provide a cordless system that does not required bulky batteries to be built inside a hand held article of sales. It is also the objective of this invention to extend the application of the concept to a toy play set comprises of miniature electronics toys which do not require internal power resource such as batteries or capacitors of ultra high capacity.

SUMMARY OF THE INVENTION

The present invention is firstly directed to a hand held article of sales having an electrical circuit. This electrical circuit may include an output device or transducer such as light bulb or LED. It may comprise a motor to provide motion output. Alternatively, it may also include a speaker to generate sound, music or voice messages. The circuitry may also include other different kinds of applications circuits such as a design to identify itself from other articles of the same family. The first characteristics of this hand held article is that there is no battery or other power storage component to be installed inside the body of the article for powering the output devices. Accordingly the size, weight and cost of the article are reduced. At least two conductive contact terminals are provided at two different locations of the article, preferably at the two sides, suitable to be held by the index finger and the thumb of a human hand. When electrical power is fed through these conductive contact terminals, the internal electrical circuit is activated. In order to feed power to this hand held article, a separated controller compartment having mating contact terminals connected to a power source and/or appropriate interfacing circuits are provided. In a preferred embodiment, these contact terminals are specially designed for attaching to the fingers of a user's hand, such as the thumb and the index finger. Alternately, a structure is provided enabling the motion of the index finger and a thumb to position the two contact terminals of the controller to the target article. When the user picks up the article, the mating contact terminals located at the fingers touch the conductive contact terminals of the article. Accordingly power is provided to the electrical circuit of the article through the finger contact action. When the electrical circuit of the article is powered and activated, it generates responses such as light, motion or sound according to the nature of the electrical circuit built inside the article. Alternately, two conductive contact terminals can be provided on the hand of a bigger toy, such as a doll to provide the same function.

The finger contact terminals are wired to the compartment that provides the power source required. This compartment can be attached to the hand, the wrist, the arm, and the waist, attached to any other location of the human body or kept inside a pocket. A velcro tape is preferred for fast attachment of the compartment to the human body. The actual power source may also be represented by one or more energy storage device, such as batteries, or a wall mounted adapter. In the application of a toy play set such as a dollhouse, a micro city or a miniature vehicles play set. Batteries are installed inside a master toy that is moved around to make contact with the accessory toys. For a louder sound to be generated, the small speaker installed inside the miniature size article or accessory toy members can be replaced by a larger speaker relocated to the power supply compartment or the master toy. In this case, the audio signal may be either obtained from a circuit built inside the article or the accessory toy, then amplified in the controller compartment of the master toy to drive the larger speaker. Alternately the electrical circuit embedded inside the target article may send a trigger signal to the sound chip located inside the controller compartment for driving the speaker. If three pairs of finger contact terminals are provided to bridge between the article and the control compartment, the audio signal and the battery connection circuit may share a common wire. If only two pairs of contact terminals are provided, the AC audio signal can be superimposed onto the DC power supply line, for the circuit to share the two conducting wires.

In the application when the audio signal is provided by the control circuit located inside the controller compartment of the hand held unit or the bigger toy, the electrical circuit inside the target article provides an identity or a triggering signal to the control circuit through the finger contacts. Accordingly, different sounds may be generated from the compartment control circuit according to which external article is picked up by the finger contacts. In addition to sound, other supporting circuits such as a display panel, LEDs and/or control buttons can be added to the compartment to provide additional features for enriching the product package.

The wires connecting in between the finger contacts and the compartment are preferably to be flexible, or adjustable to suit for different hand sizes. The finger contact terminals can be designed to be part of a ring, a finger cap, or a glove for attaching to the tips of a finger. In order to avoid accidental short circuiting the power source when the two finger contact terminals are touching each other, a short circuit sensor, and/or other protection circuit such as analog to digital (A/D) feed back circuit, a current limiter, a fuse or a high current shut down circuit can be provided to prevent any short circuit hazard. Alternately, a fingertip contact terminal can be structured only for touching the contact terminals of the target articles but not the adjacent finger tip contact terminal. For example, each fingertip contact terminal can be protected by a protruded nonconductive wall so that two fingertip contact terminals are not allowed to touch each other. However, the mating conductive contacts on the article side can be formed to provide a smaller mating protruded shape so that they are free to be contacted by the finger contact terminals.

Preferably a family of different target articles such as a series of accessory toy members having similar contact designs are to be provided to enrich the value of the package. A first preferred embodiment of the article is a miniature flashlight having a light bulb or a LED connected to two contact terminals located at the opposite sides of the flashlight. When the fingers pick up the flashlight, electricity is provided from the battery compartment, conducted through the contact terminals for lighting up the light bulb or the LED. A modification of the concept is to provide a light bulb or LED inside a flying object such as a dart, a ball, or any other projectile article. An energy storage device such as a miniature battery or a capacitor can be built inside this projectile article to continuously light up the LED after the flying object left the hand of the user. The energy storage device will continue to light up the light bulb or LED for a short period of time after external power is discontinued.

Other embodiments of the invention include toy articles of different personality defined by different shapes, such as dolls; action figures; toy character and toy size vehicles; building structures in a toy play set such as a gas station or a rotating radar station; airplanes; helicopter or toy size electrical hand tools. For a game set making use of the invented technology, it may be convenient to provide a same housing injection molding tool for different accessory toy members. In this case, the different shape required to define the different personality of each accessory toy member may be provided by a picture attached on the accessory toy housing to illustrate the different shapes of the accessory toy member it represents. Other than different shapes, a motor is included in many of these toy articles to provide motion response when the target article is powered by the touching action. It should be noted that although many toy articles such as the wheeled vehicles should be miniature reproductions of the life size products, the application of the invention on electrical tools could be extended to regular life size tools.

In the case the target article is a member of a toy family, such as dolls; toy play set; dollhouse; wheeled vehicles or action figures, an identifying circuit can be built inside the toy to differentiate one member of the family from another. When the toy is picked up, the interface and/or controller circuit inside the compartment reads the identifying signal from the toy. The nature of the toy is then identified by a detection circuit. Different voices, visual displays, motions or interactive responses tailor designed for that particular toy member may be generated. A simple way of embedding an identifying circuit inside the toy is to provide a specified valued electrical component such as a resistor or a capacitor. When the toy is in contact with the user's fingers, the value of the resistor or capacitor is measured by the interfacing circuit and/or the controller located inside the controller compartment. Different component values, each represents a different toy, directs the controller to provide different voice or interactive responses. Typical interfacing circuit capable of identifying a resistor value such as A/D converter, comparator circuit or bridge circuit are applicable to serve this application. Allowing all the accessory toys of different personality, function or shape to share the same power source located at the controller compartment of the master toy is another distinctive benefit of the invention.

A further enhancement of the invention is to provide a toy for the children to explore the electrical characteristics of different external objects, or materials. In a preferred embodiment, the resistance of the object contacted by the fingers are evaluated and responses are provided by voice, light or a message displayed on a visual area, such as a LCD panel. When a very low resistance is detected, the response can be: "This is a metal". When a very high resistance is read, the response is "This is not conductive." When a medium resistance is read, the unit response: "Is it a human skin?". When low to medium resistance is detected, the response may be "It feels wet?". Alternately, a tone can be generated and the frequency or volume of the tone can vary according to the resistance or capacitance detected by the two finger contact terminals.

In another embodiment, this fingertip exploring device or activation by contact toy set is configured to become a battery tester. When the finger contact terminals are placed across a battery, the controller and interface circuit inside the compartment detects an external voltage. The initial voltage is first read. The battery voltage is then connected to a predefined load and the loaded voltage is read again. The comparison between a no load voltage and a loaded voltage will indirectly reflects the strength of the battery under test. The result can be announced by voice, or visually represented by a meter, LED indicator or LCD display.

In the prior art technology, a play set such as a dollhouse or a miniature vehicle and micro city play set comprises of sensors, switches, and transducers such as motors, light bulbs, LEDs are installed at different locations of the play set. All these devices are wired to a central controller board and derive power from a centralized power source located at a particular position of the play set. The excessive wiring not only creates quality issues, but also limits the structure and position of the play set accessory members. The play set accessory members is impossible to be repositioned according to the wish of the kids. In an improved play set embodiment supported by the invented technology, each element or accessory member of the play set has its unique identity or personality, characterized by different shapes such as a TV, a microwave oven or a pet. The different accessory toy members are also characterized by different responses generated, such as a rotating radar station or a police car generating a siren sound. The master toy represented by the doll, a miniature vehicle or a toy unit controlled by finger contacts accommodates the power source, the audio signal driver circuit and the speaker. As a play pattern, the master toy member is moved around the play set unit to interface with different accessory toy members. When the master toy is in contact with an accessory toy member, the power of the master toy member is fed to the accessory toy member to initiate the different responses unique to each accessory toy member. Typical responses are provided by motorized animation; lighting effect generated by light bulb or LEDs and sound generated by sound generating integrated circuits. Since speaker is also a component of substantial size, the speaker is recommended to be installed inside the master toy unit. In this situation, the power contact terminals supplying current from the master toy unit to the accessory toy members are also required to carry analog or digital signals that represent an audio signal to be sent from the accessory toy member back to the master toy unit.

Unlike the contact terminals located at the fingertips of an user, the contact terminals located at a master toy unit is usually fixed in position relative to each other. Therefore the contact terminals of the accessory toy members are to be properly dimensioned and positioned to enable contact making with the power terminals of the master toy unit. In an embodiment, the contact terminals are located at the hand of a doll. In another embodiment, the contact terminals of the master toy unit are represented by the conductive corners of a master toy vehicle. Alternately, contact terminals can be located at many other convenient locations of the master toy unit, such as the feet of a doll or a podium connected to the master toy. As required by the specific circuit requirements, correct contact polarity is important for the toy set to function properly and to avoid damage of the electronics circuit. Avoiding short circuit damage at the power supplying side is also very important. Since toys are designed for young children who have no concept about electricity polarity, there is a desire to provide a circuit which has a built in protection circuit that automatically cut off or limit the current supply when the power contact terminals are short circuited. It is also a preferred feature to provide a circuit design that enables the master toy and the accessory toy to be connected in reversed polarity.

Product cost is reduced, quality is improved when wirings are eliminated and the size of the accessory toy members is shrunk. Another significant advantage of the improved toy set application is that each interactive accessory toy member can be positioned at different locations. Accordingly discrete or separated accessory toy members are possible to form a toy play set. For example, a dollhouse may comprise of different loose pieces of furniture, utilities and fixtures each has its internal electrical circuit to be powered by the doll. A micro city may comprise of different individual building structures or miniature vehicles, each has a different personality and provide a different response when power is received. The dollhouse accessories are no longer required to be fixedly located in the dollhouse as in the prior art interactive dollhouse. The micro city or vehicle play set is no longer made of buildings or structures fixed in position to each other. The play value is enhanced because the children have the freedom to furnish their own dollhouse or to build their own design of the micro city.

It is also the goal of the invention to provide a matching integrated circuit (IC) chip sets that is suitable for providing the aforementioned specific functions for the master toy member and the accessory toy member. The IC chip designed for the accessory toy member is characterized to receive power from two power lines and to generate digital or analog audio signal to an external master toy member though the same power lines. This IC chip is preferred to have an internal delay or stabilizing circuit to automatically initiate the sending of audio signal when power is received. The second IC of the chip set locates at the master toy side. This IC chip is characterized by a circuit configured to extract the audio signal from the power line connected to the accessory toy. The second IC is also configured to convert the analog or digit audio signal to drive a sound transducer, such as a speaker. Preferably, the second IC chip is designed to drive the speaker in both directions so as to make full use of the dynamic range of the speaker. Integrated circuit designed for this specific Green Voice function had been disclosed in applicants issued U.S. Pat. Nos. 5,990,739 and 6,163,214.

The novel features of the invention are set forth with particularity in the appended claims. The invention will best be understood from the following description, when read in conjunction with the accompanying drawings.

DETAILED DESCRIPTION

Figure 1:
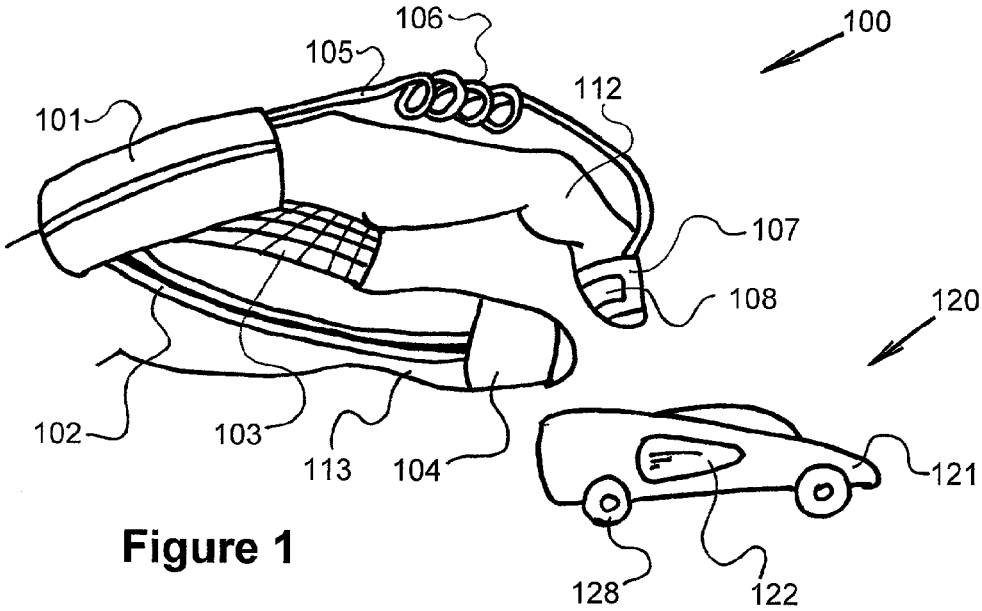
FIG. 1 illustrates an embodiment of the hand-attached controller and the target toy car to be touched by the finger contacts of said controller.

Attention is initially directed to FIG. 1, which depicts the combined application of a controller embodiment 100 and an article of sale embodiment 120 in accordance with the invention. The controller 100 comprises a compartment 101, a velcro tape 103 to attach the compartment 101 to a human hand; two finger caps 104, 107 for attaching to the thumb 113 and the index finger 112. On each of the finger cap is a conductive contact terminal 108. Each contact terminal is connected to the compartment 101 by conducting wires 105 and 102. The conductive wire 105 has a flexible; elastic or coiled segment 106 for adjusting the distance between the finger cap 107 and the compartment 101. Alternately, the exposed length of the wire 102 can be adjusted by hiding some segment of the wire inside the compartment 101. Inside the compartment 101 are batteries that provide power to the external target article, the toy car 121. Two contact terminals 122 are positioned at the two sides of the toy car 121 such that when the car is picked up by the fingers 112, 113, each contact terminal 108 makes contact with the corresponding contact terminal 122 of the car and provides power to the electrical circuit inside the car. A motor linked to the wheels of the car is provided inside the car. The terminals of this motor are connected to the contact terminals 122. As soon as the finger contact terminals 108 touch the contact terminals 122, the motor is powered by the batteries inside the compartment and starts to run. Alternately an electricity to light transducer such as LED is included inside the car. The LED will be lit when the car is picked up. In an alternate embodiment the electrical circuit located inside the car is an identifying circuit, which provides some electrical identification characteristics, the electrical circuit inside the compartment picks up the identification through the finger contacts and responses with some sound effect appropriate with the characteristics or personality of the target article, the car 121. For example, when an ambulance is picked up, a siren sound is generated. If an ice-cream retail van is touched by the fingers 112, 113, a music box type of melody is played.

When the concept is extended to a micro city play set, different vehicles each has a different shape, function or personality are provided. Some vehicles produce a personalized sound when energized. Some vehicles provide blinking light when powered. Some other vehicles may include a motor to provide visual animation. Alternately different fixtures or building structures may be included in the play set. Each building is also configured to provide a different sound, light or animation response when energized. For example, a radar station may provide a rotating radar antenna when energized. A gas station may provide a gas pumping sound when energized. A candy shop may provide a blinking neon light when power is received. Different rescue vehicles may provide different type of dialogues when they are energized. When the invention is extended to a girls toy play set, accessory facilities normally found inside a doll house are provided. Each accessory provides a different sound, light or motion response when power is received from the controller compartment, or from a master toy that provides power and generates sound. Other than the finger contact design, the controller compartment can be housed inside another master toy member that fits naturally with the play set. The master toy is the key character of the play set that moves around to conduct the show. In an embodiment, the controller compartment is hidden inside a doll that makes contact with different dollhouse facilities to obtain different interactive audio, light or motion responses according to the different personality of the accessory toy member. Since the master toy member is to be connected to different accessory toy members of significantly different shape by small kids, it is essential to provide a simple and easy to operate method of connection in order for the toy set to be of good play value. Accordingly there is a high desire to minimize the number of contacts required to interface between the master toy member and each of the accessory toy members. Two contacts is the natural minimum number of the design in order to pass electrical current from one toy member to another. Therefore during the inventive steps, lot of efforts are spent to enable sending of analog or data signals to share with the two power lines that handle different requirements such as low current voice chips and high current light bulbs and motors. Short circuit protection adds another level of difficulty to the design of the combined power supply and interfacing circuit. Providing capability for the two pairs of contact terminals to identify the nature of the accessory toy member under contact adds more complication to the circuit design. Solutions to most of the design challenges identified are discussed in the following description.

Figure 2:
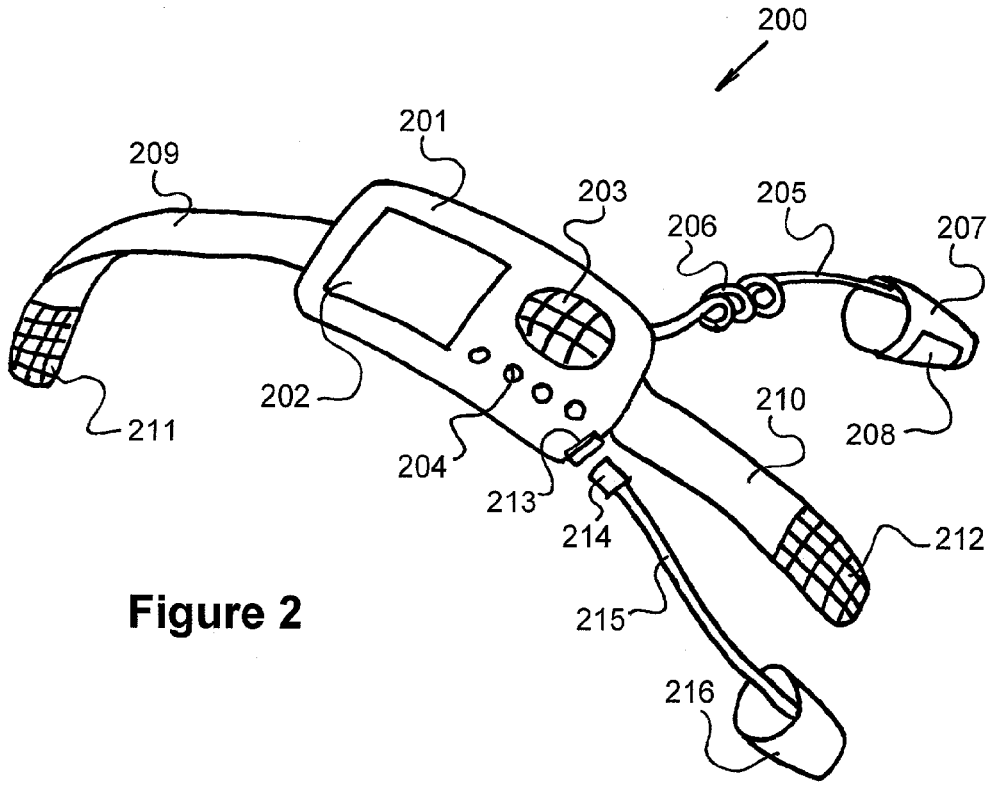
FIG. 2 illustrates another preferred embodiment of said hand attached controller.

Attention is now directed to FIG. 2, which illustrates another controller unit 200. On top of the compartment 201 are a LCD display panel 202, a speaker area 203 and input buttons 204. Two segments of mounting tape 209 and 210 extends from the opposite sides of the compartment are provided for attaching the controller compartment to the hand of a user. Mating velcro segments at the ends of the tape 211 and 212 enable the compartment to be fitted with hands of different sizes. It should be noted that other than the hand, the compartment can be stored or attached to other many different parts of the human body. The controller compartment is linked with the contact terminals 207 and 216 by the conducting wires 205 and 215. At the end of the conducting wire 215 is a plug 214, which is configured to be plugged into the socket 213 for conducting electricity between the compartment and the finger tip contact terminals 208. More than one receiving locations of the plug 214 are possible for adjusting the exposed dimension of the wire 215.

Figure 3:
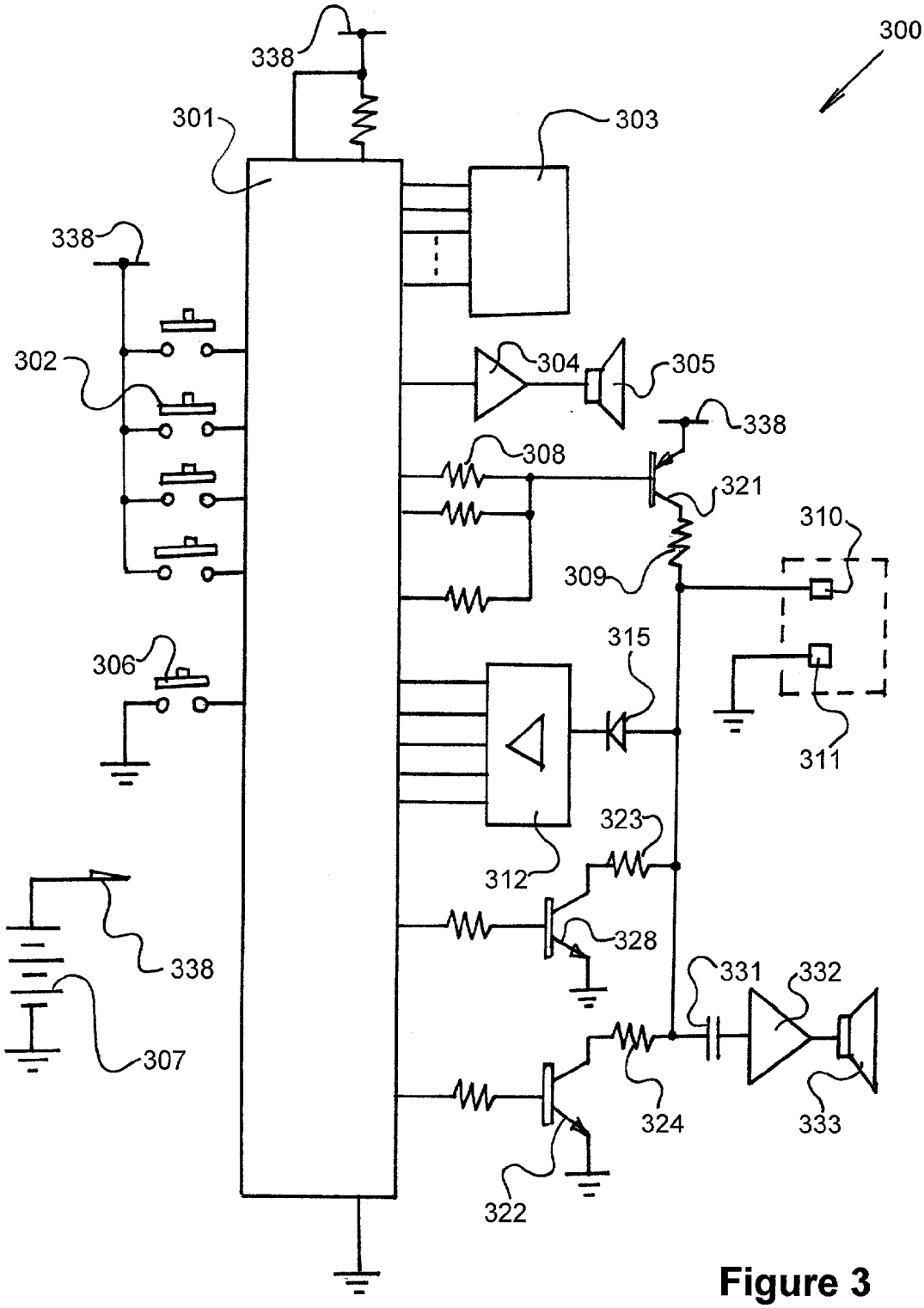
FIG. 3 is an embodiment of the control and interface circuit built inside a hand attached controller.

FIG. 3 illustrates an embodiment of the electrical circuit included inside the compartment 201 of FIG. 2 or inside a master toy member of a play set. The compartment provides a power source represented by the batteries 307 connected to different power points 338 of the circuit. When the microcontroller 301 sinks current through the resistors 308, the transistor 321 is turned on and an electrical current is fed to the external target article or accessory toy member through the contact terminals 310 and 311. Contact terminals 310 and 311 are represented by the contact terminals 108 as illustrated in FIG. 1. The amount of current provided to the target article or accessory toy member is controlled by the amount of base current fed through the control resistors 308. These resistors may also works as a D/A (digital to analog) converter to translate digital signals provided by the microcontroller into an analog signal for feeding the external target article. Resistor 309 limits the amount of the current flowing through the contact terminals 310, 311 in case of excessive current drawn. The control buttons 204 of FIG. 2 are represented by the switches 302 of FIG. 3. Reset switch 306 is provided to reset the microcontroller 301 when required. The circuit may provide a LCD display unit 303 that is represented by the display panel 202 of FIG. 2.

In a different preferred embodiment, the controller 200 of FIG. 2 is configured to become a battery tester. When the fingertip contact terminals 216 are in contact with the terminals of a battery, this voltage is converted into digital readings by the A/D (analog to digital) converter 312 and then read by the microcontroller 301. The diode 315 protects the circuit when the battery polarities are inverted. The microcontroller may also turn on the transistors 328 and 322 to provide an artificial load to the external battery. The battery voltages at different loading conditions are analyzed and accordingly the power capacity of the battery is indicated on the display panel 303 or announced by the speaker 305. Alternately, the microcontroller 301, audio signal driver 304 and audio transducer 305 can be configured to generate an audio sound converted from the audio data received from the contact terminals 310, 311.

In another embodiment, the external target article comprises of different accessory members of a family of toys, each having a unique identifying circuit embedded inside the toy. When this identifying circuit, such as resistors of different unique values, is in contact with the contact terminals 310, 311, the A/D circuit 312 reads the value of the resistor. With a predefined resistance look up table built inside the software program, the microcontroller is able to identify the specific toy article picked up by the fingers 112, 113 of FIG. 1. Accordingly different voice messages or interactive responses custom designed to the target article can be produced. Alternately, different custom designed visual messages can be displayed on the LCD panel 303.

In another further application, the external target article comprises an embedded voice chip. When the target article is powered up by the DC electrical current supplied by the transistor 321, an AC voice message can be generated and sent back to the contact terminals 310, 311. This AC voice message is filtered by the capacitor 331, amplified by the amplifier 332 and drives the speaker 333. In real world application, the two speaker driving circuits should be combined to save cost.

Figure 4A:
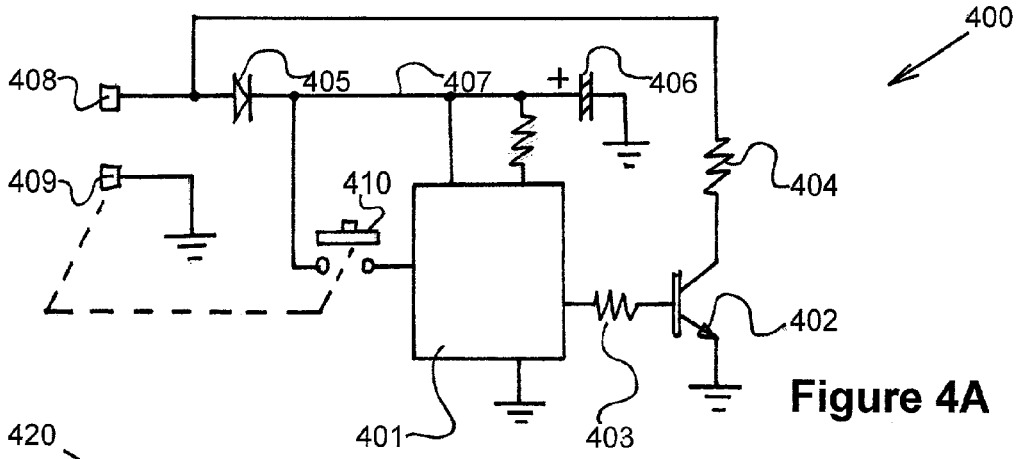
FIG. 4A is an embodiment of an interface circuit built inside an article of sales to be contacted by the mating contact terminals connected to a controller.
Figure 4B:
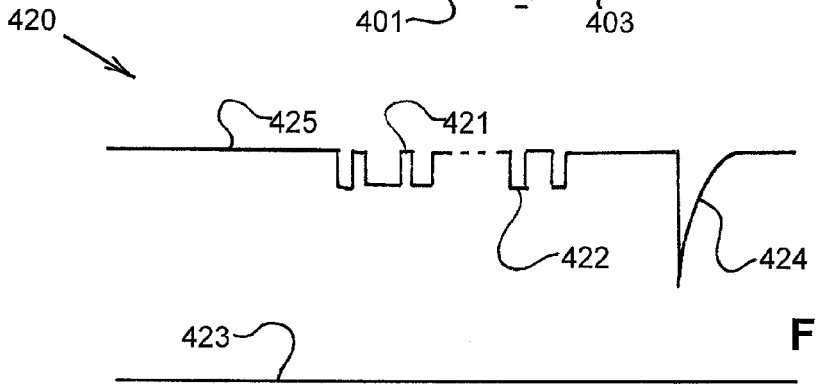
FIG. 4B is the waveform of the electrical current flowing through the contact terminals and the interface circuit of FIG. 4A.

Attention is now drawn to FIG. 4A illustrating a preferred embodiment of an electrical circuit 400 included inside the body of a target article or an accessory toy member. This circuit is able to generate digital signals when power is received. The digital signal can be used for signaling the identification of the target article or serve other applications. The contact terminals 408, 409 represent the conductive terminals positioned outside the target article, such as the contact terminal 122 of the toy car 121 in FIG. 1. The heart of the circuitry is a microcontroller 401. The microcontroller is powered by the external voltage obtained from terminals 408, 409. The capacitor 406 is included as a filter and also a power reservoir to store electrical energy when the contact terminals are momentarily out of contact. When power is connected to the contact terminals 408, 409, the microcontroller is powered up. At this moment, the voltage waveform across the terminals 408 and 409 is illustrated in FIG. 4B. Once the electrical circuit is stabilized, the microcontroller 401 generates a series of pulses 421 and 422 according to the nature of the target article. These pulses turn the transistor 402 ON and OFF and accordingly giving a pulsing loading to the power line through the resistor 404. The amplitude of the pulses 421 and 422 is determined by the value of the resistor 404 and the internal impedance of the interfacing circuit at the controller or master toy member. The pulses 421 and 422 are then processed by the electrical circuit at the controller end. Responses are generated according to the pulses detected. The diode 405 of FIG. 4A is included to attenuate the pulsing signal to enter the power supply line 407 of the microcontroller circuit.

In order to determine when the microcontroller 401 should generate pulses and what kind of pulses can be generated, a trigger switch 410 is included in the circuit 400. In many applications, the target article is accessed by only two fingers, which also provide the contact function to power up the chip. Therefore the switch 410 is preferably be integrally positioned right behind the contact terminal 409, so that the switch 410 can be triggered by the same finger accessing the contact terminal 409. Likewise, a controller switch is preferred to be linked to the mechanism of the controller side contact terminals such that this switch can be triggered by the same thumb and index finger controlling the movement of the controller side contact terminals. Another advantage of this design is that the electrical circuit can be set to a low power standby mode to conserve energy. The circuit is revoked to the normal operation mode only when this controller switch is triggered. Alternately, the circuit of the target device or accessory toy member can be activated by a delay after power is sent to the integrated circuit. In this case the trigger switch 410 is not required.

Figure 4C:
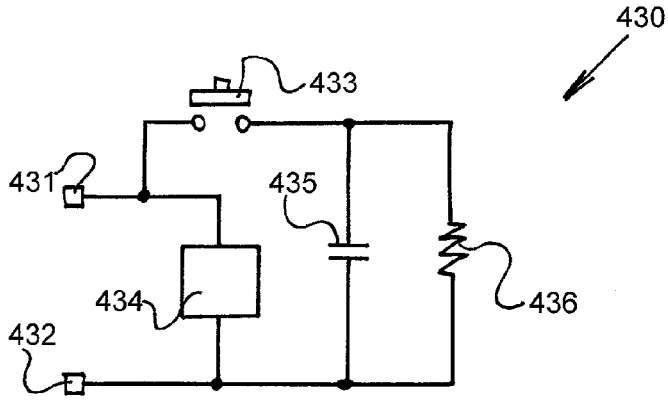
FIG. 4C is another interface circuit built inside an article of sales to be touched by the mating contact terminals connected to a controller.

FIG. 4C illustrates another generic circuit applicable for the target article or accessory toy member. The block 434 represents the loading circuit of the target article. It can be an analog circuit, a digital circuit or a programmable circuit. It can also be a simple loading circuit such as a motor, a light bulb or a LED. An optional triggering circuit is provided by pushing the switch 433 which connect the capacitor 435 to the power line of the circuit. The capacitor 433 will provide a momentary negatively going triggering pulse 424 as shown in FIG. 4B. This trigger pulse will be useful to trigger the electrical circuit located at the controller end. The resistor 436 is included for discharging the capacitor 435 when the trigger switch 433 is released.

Figure 5A:
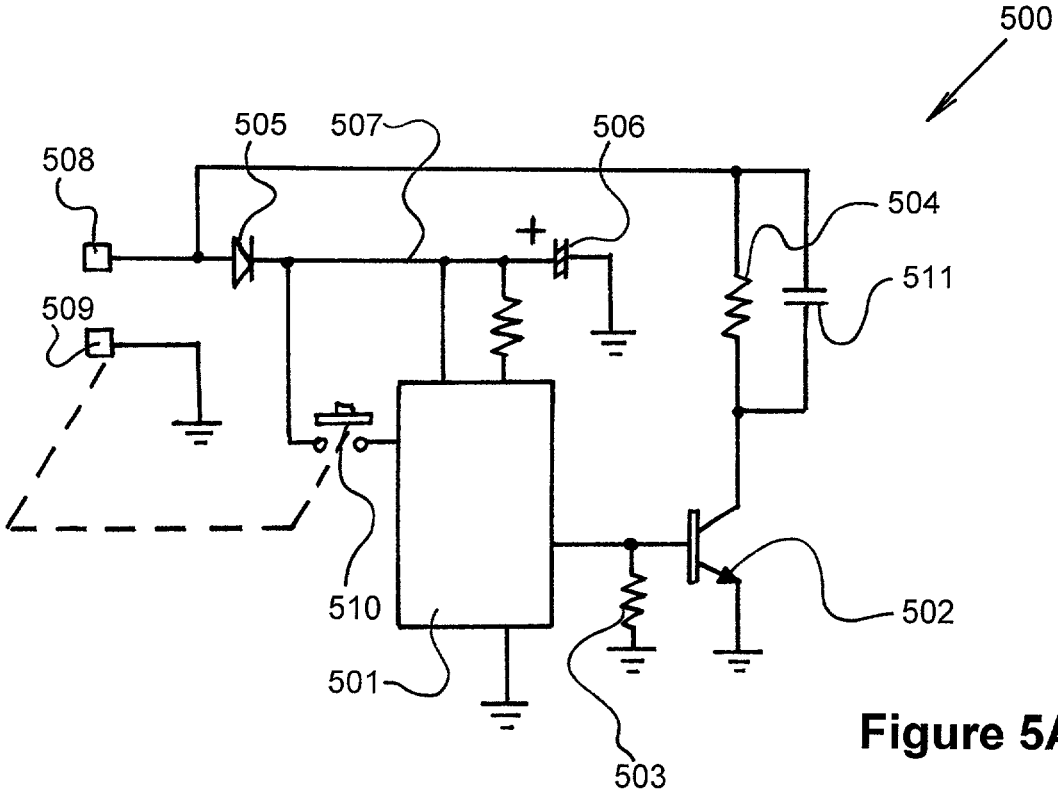
FIG. 5A is an example of a sound generating interface circuit built inside an article of sales.
Figure 5B:
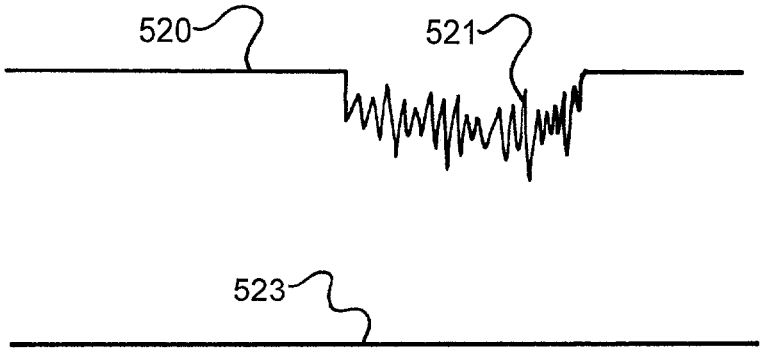
FIG. 5B is the waveform of the electrical current flowing through the contact terminals and the interface circuit of FIG. 5A.

FIG. 5A is a design alternative of FIG. 4A, wherein the functional block 501 generates an analog signal such as a voice waveform. This voice waveform is amplified by the transistor 502 and coupled to the contact terminal 508 by the capacitor 511. The DC voltage measured across the terminals 508 and 509 are represented by the voltage waveform 520 of FIG. 5B. The coupled AC signal is represented by the analog waveform 521.

Figure 6A:
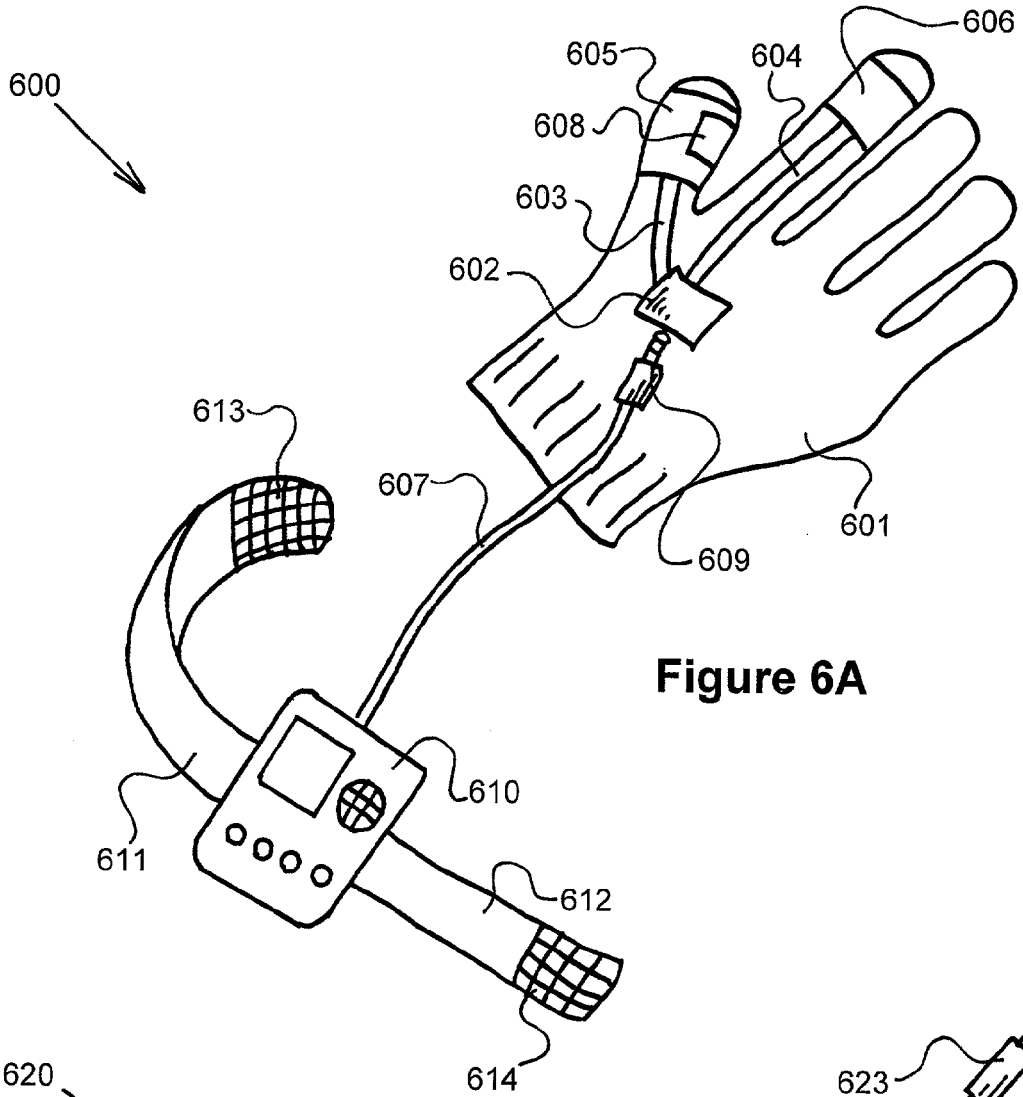
FIG. 6A illustrates another preferred embodiment of the controller.
Figure 6B:
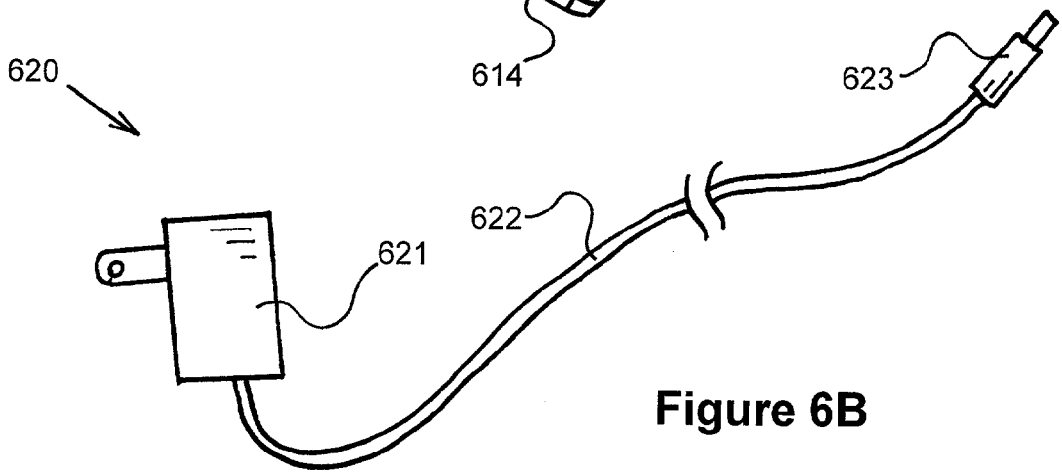
FIG. 6B illustrates an optional wall mounted adapter configured to provide power to the controller compartment.

An alternative preferred embodiment is illustrated in FIG. 6A having a glove 601 and a controller compartment 610. The controller compartment 610 is identical in nature to the controller compartment 201 of FIG. 2. The mounting tapes 611, 612 are structured to mount the controller compartment to the wrist or the arm of the user. The cable 607 connects the controller compartment to the finger contact terminals 608 located at the glove. An optional connector plug 609 and socket 602 are included for easier installation of the controller set. In case of an electric tool application, the controller compartment package 610 can be replaced by a simple battery box or the wall mounted adapter 620 of FIG. 6B. The plug 623 is simply connected to the socket 602 of the glove 601 to provide electricity to any electric tool picked up by the fingers 605, 606.

Figure 7A:
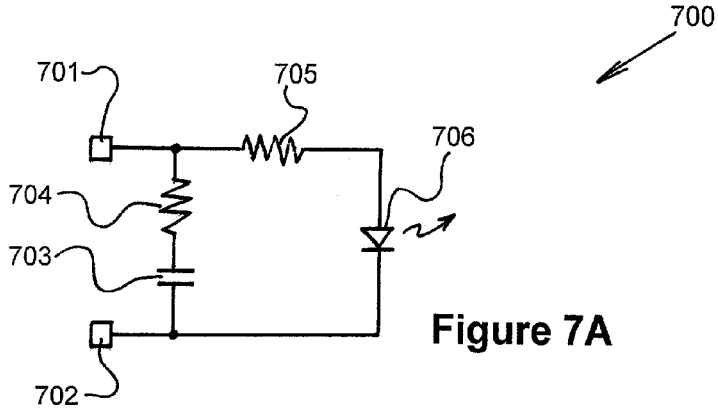
FIG. 7A is a light generating circuit build inside an article of sales.
Figure 7B:
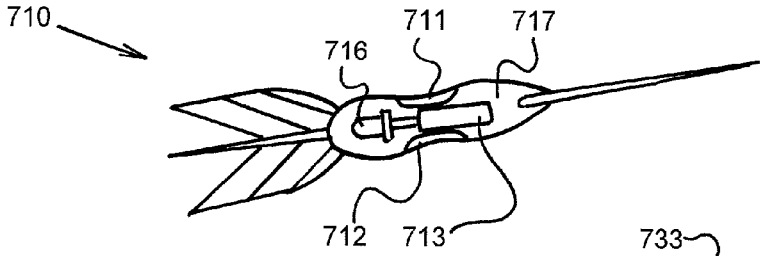
FIG. 7B illustrates the internal structure of a dart making use of the circuit illustrated in FIG. 7A.

Attention is now drawn to other preferred embodiments of the target article or accessory toy member. Illustrated in FIG. 7B is an electronics dart having an electrical circuit built inside the dart. The body 717 of the dart is made of a transparent or translucent material. Embedded inside the dart are a light emitting transducer 716 and an optional energy storage reservoir 713. At the two sides of the body are the conductive contact terminals 711 and 712 for conducting power to the internal circuit of the dart. FIG. 7A illustrates an embodiment of the circuit inside the dart. The light emitting transducer 716 is represented by the LED 706. The energy reservoir 713 is represented by the capacitor 703. The resistor 705 defines the intensity of the LED. The charging current of the capacitor 703 is limited by the resistor 704. The LED 706 is lit when finger contact provides electrical power to the contact terminals 711 and 712. The capacitor 703 is also fully charge up when the electrical power is maintained for one to two seconds. When the dart leaves the hand of the user, the LED continuously to be lit until the electrical power stored inside the capacitor 703 is used up. This design provides a beautiful taillight along the projectile of the dart. The lighted up dart not only enhances the fun of the game, but also makes it easier for a movie camera to capture the slow motion of the flying dart.

Figure 7D:
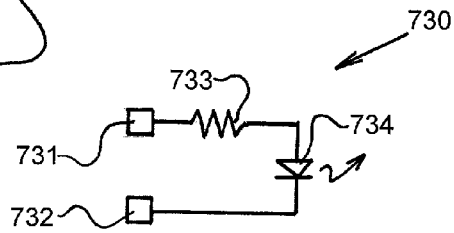
FIG. 7D illustrated a simple LED circuit build inside an article of sales.
Figure 7C:
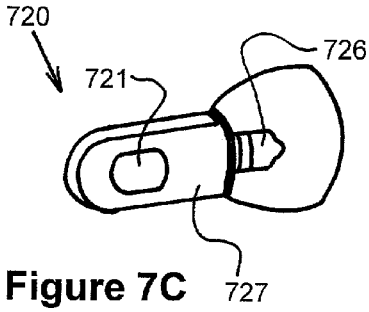
FIG. 7C illustrates a flashlight making use of the circuit illustrated in FIG. 7E.
Figure 7E:
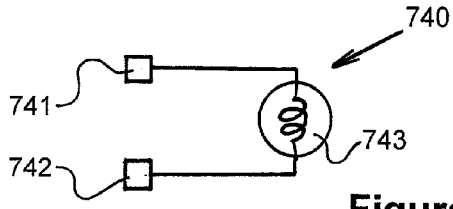
FIG. 7E illustrates a light bulb circuit built inside an article of sales.
Figure 7F:
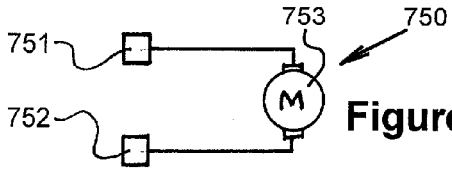
FIG. 7F illustrates a motor circuit built inside an article of sales.

FIG. 7C illustrates a miniature profile flashlight. It has a light emitting transducer 726 positioned in front of the body 727. At the two sides of the body 727 are the contact terminals 721 structured to receive power through the finger contact. It can be observed that the body of the flashlight is very thin because no battery is required to be built inside the flashlight. The light emitting transducer is represented by the LED 734 of FIG. 7D or the light bulb of FIG. 7E. Other than light emitters, the target article may include a motor 753 as illustrated in FIG. 7F to provide motion or animation as soon as the user's fingers are in touch with the contact terminals of the target article.

Figure 8A:
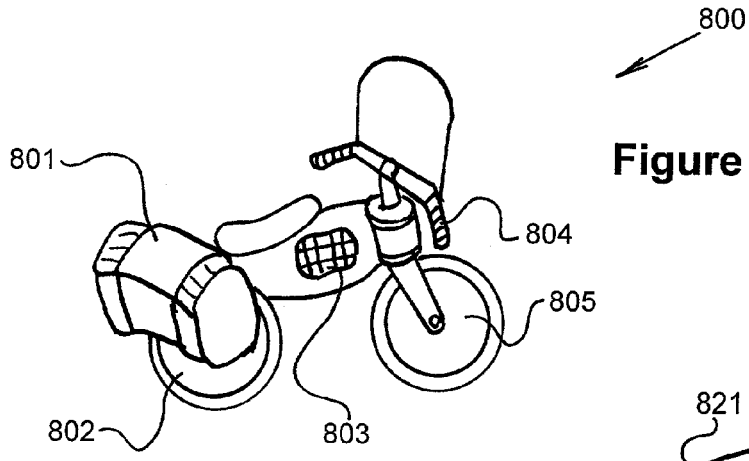
FIG. 8A is a toy motorcycle having a built in motor.

FIG. 8A illustrates a motorcycle 800, another wheeled motor vehicle designed with the invented technology. At the two sides of the motor cycle 800 are the contact terminals 803. A motor and a gear mechanism are installed inside the compartment 801 and linked to the wheel 802. The motor is connected to the contact terminals 803 as shown in FIG. 7F. As soon as the contact fingers pick up the motorcycle, the motor starts to rotate. The finger contact terminals extended from the controller compartment are preferred to be attached to the middle finger and the thumb. This is to free up the index finger for controlling the steering of the front wheel 805 and the steering mechanism 804. Alternately an action figure or a doll having an internal power source can be used to energize the motorcycle. Electrical current is feed to drive the motor through mating pair of contact terminals.

Figure 8B:
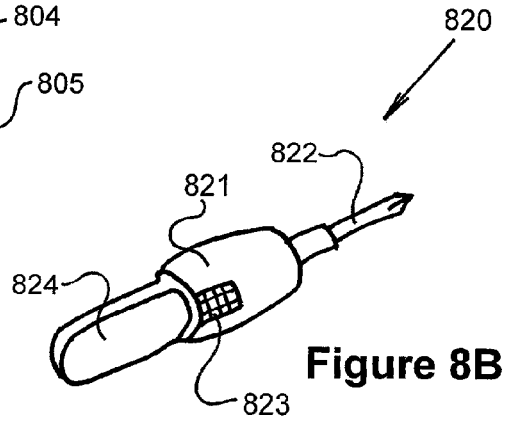
FIG. 8B is an electrical hand tool having a built in motor.

FIG. 8B is an electric screwdriver 820, a hand tool example structured to interface with the finger contact power supply assembly. Inside the housing 821 is a motor and a gear box. The motor is connected to the contact terminals 823 located at the two sides of the housing. Since there is no built in battery, the handle of the screw driver is shrunk to a small size just adequate to be held by the hand of the user. As soon as the tool is picked up by the finger contact terminals, the screw driver starts to turn. This is a very handy way to start or stop a low voltage electrical hand tool by simply making contact with a finger. The benefits of this arrangement is that the weight of the electrical hand tools is lighter, the size is smaller and the cost is lower. It should be noted that the electrical hand tool can be a life size tool for regular jobs or a miniature toy grade hand held tool designed for kids only.

Figure 8C:
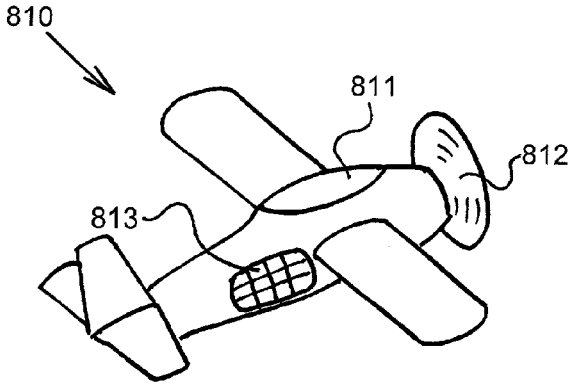
FIG. 8C is a toy airplane having a built in motor.

FIG. 8C is a toy airplane having a motor built inside the body 811. The motor is connected to the contact terminals 813 located at the two sides of the body 811. When the airplane is held by the power supply finger contacts, the propeller 812 which is linked to the motor starts to rotate for the kids to simulate a flying airplane. Alternately a helicopter can be provided to serve the same play pattern.

Figure 8D:
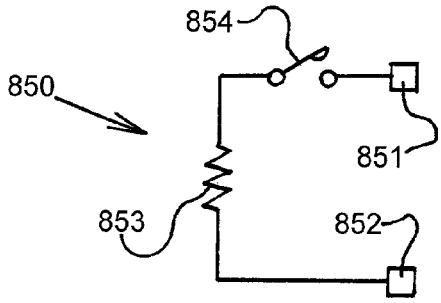
FIG. 8D is a circuitry having an identifying component connected to the contact terminals of a target toy.
Figure 8E:
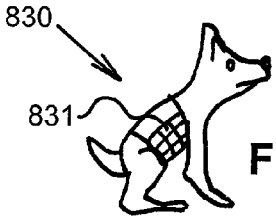
FIG. 8E is a toy pet having two contact terminals at both sides.
Figure 8F:
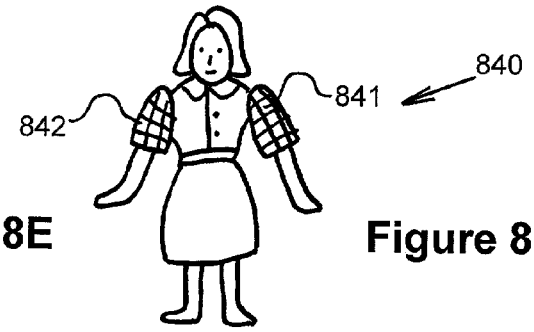
FIG. 8F is an accessory doll having contact terminals at both sides.

FIG. 8E is a toy size pet 830 having two contact terminals 831 located at the two sides of the pet. Inside the torso of the dog is an identity circuit represented by a resistor as shown in FIG. 8D. When the dog is held by the finger contact terminals, the controller circuit reads the value of the resistor 853 which identify the presence of the dog. In response a barking sound can be generated to drive the speaker represented by 203 of FIG. 2 and 305 of FIG. 3. The barking sound is represented by electronics data stored inside an integrated circuit embedded inside the dog, inside the control compartment or inside the master toy member. FIG. 8F is a doll equipped with a different resistor value. This design demonstrates that the accessory toy member can itself be in the shape of a doll. When the contact terminals 841 and 842 are touched by the finger contact terminals, the sound of a girl can be generated from the speaker 203 of FIG. 2 and 305 of FIG. 3. An optional switch 854 is provided in the identification circuit so that the resistor is not connected until the switch is closed. The optional switch is preferred to locate behind one of the contact terminals. This optional arrangement allows the user to touch the contact terminals without immediate triggering the voice or visual response. The voice or visual response is generated only when the switch is pressed.

Figure 9A:
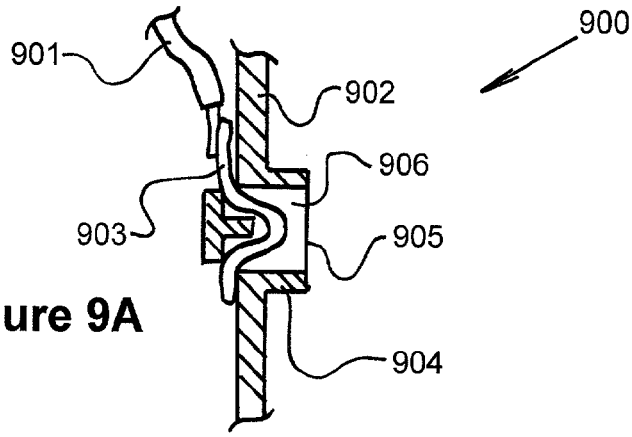
FIG. 9A is a sectional view describing the stopper wall surrounding a contact terminal of the controller side to prevent it from short circuiting with an adjacent contact terminal.
Figure 9B:
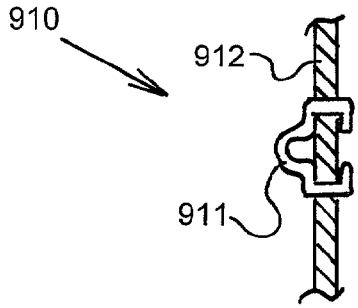
FIG. 9B is a mating contact terminal to be received by the contact terminal of FIG. 9A.

FIG. 9A illustrates a finger contact design structured to prevent short circuit when two finger contacts are in touch with each other. The conductive contact terminal 903 is soldered to a wire 901 connecting to the control compartment. 904 is the protective wall formed around the contact terminal 903 such that it will not be possible to contact any surface with an area bigger than the opening 905. Accordingly the contact terminal 903 will not be possible to contact another contact terminal of identical structure. FIG. 9B illustrates the mating contact terminal having a protruded contact area 911 provided to a target article. The exposure of this protruded area 911 is smaller than the opening 905 and therefore is able to enter the cavity 906 for connecting the contact terminal 903.

Figure 10:
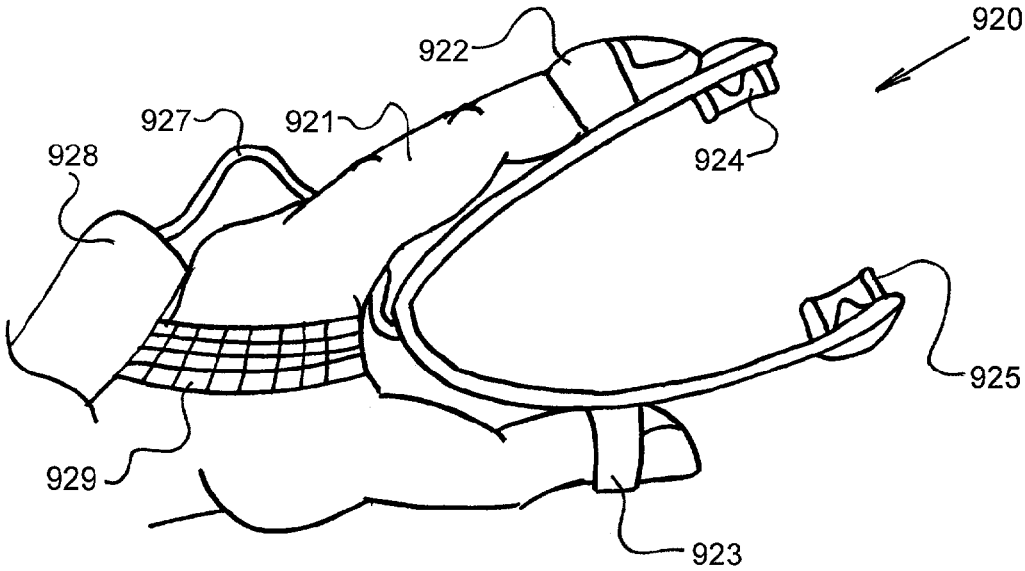
FIG. 10 is an alternate embodiment of the structure holding two contact terminals and allowing these contact terminals to be positioned by the fingers of a human hand.

FIG. 10 illustrates another embodiment 920 having a controller compartment and finger touching structure similar to that of FIG. 1, except that a further connecting frame in the shape of a pair of forceps is provided to hold the finger contact terminals. The motion of the first contact terminal 924 is controlled by the movement of the finger 922. The position of the contact terminal 925 is controlled by the movement of the finger 923. The space in between the contact terminals is structured to be larger than the target article to be connected.

Figure 11:
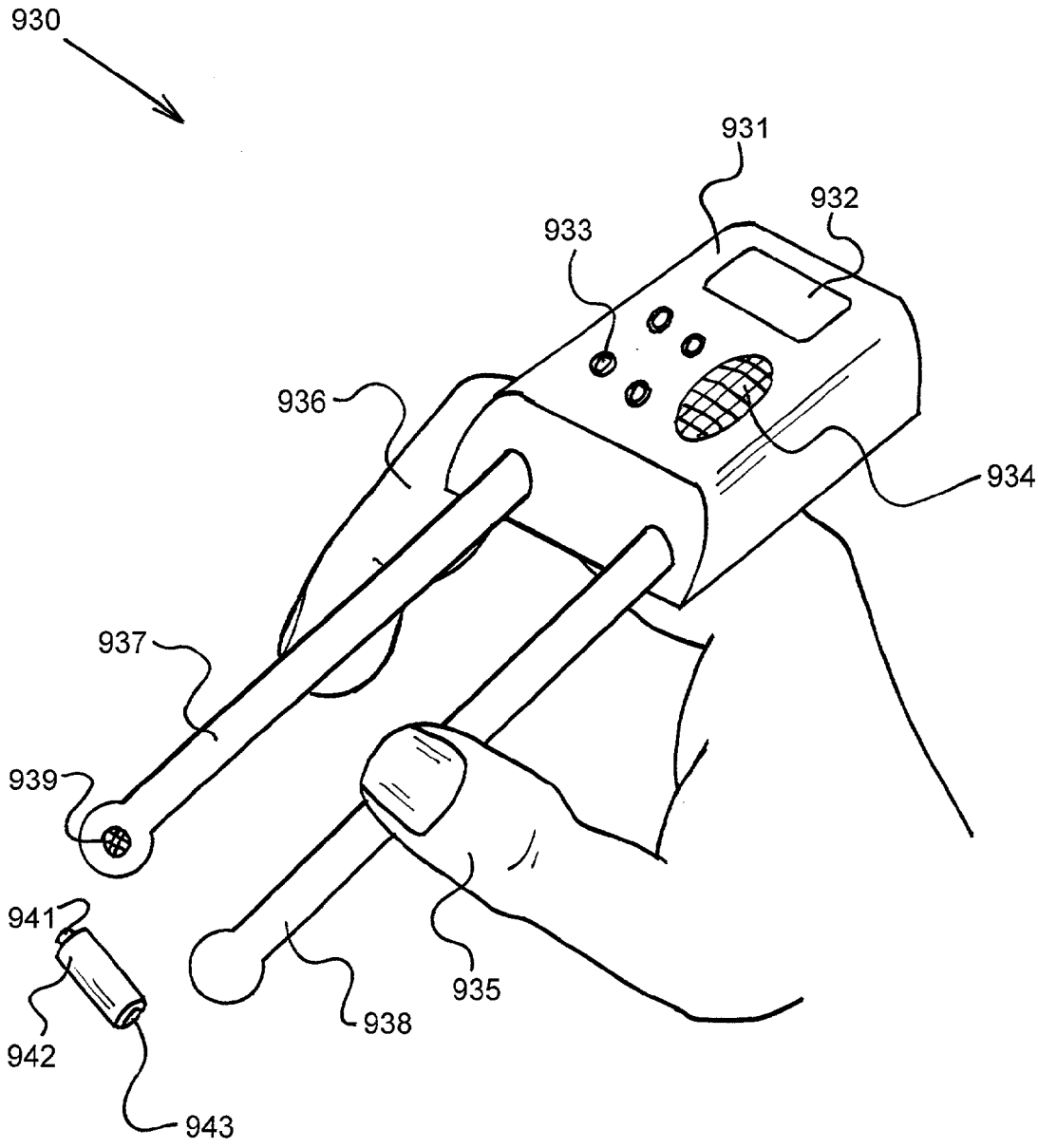
FIG. 11 is another modified embodiment of FIG. 10 structured for testing batteries.

FIG. 11 illustrates an enhanced embodiment structured to test batteries. Instead of attaching the controller compartment to the hand of the user, as shown in FIG. 10, the compartment 931 is connected to the proximal portion of the forceps tongues 937 and 938. The forceps tongues 937 and 938 are made of elastic material with an opening wider than the battery to be measured. Alternately pivots may be provided at the proximal ends of the tongues 937, 938. When a battery 942 is positioned in between the forceps, the tongues 937, 938 are squeeze by the two fingers 935, 936 of the user such that the positive and negative terminals of the batteries 941, 943 are connected to the corresponding contact terminals 939 located at the remote ends of the forceps tongues. Attention is now drawn to the electrical circuit of FIG. 3. The battery voltage is fed to the electrical circuit of the controller through the contact terminals 310 and 311. This voltage is converted into digital values by the analog to digital converter 312 and read by the microcontroller 301. Artificial loading of the battery under test can be achieved by turning on the transistors 328 or 322. Different types of batteries usually required different loading values for determining the current supplying capability of the battery. The voltage drop between a full load and a no load condition is analyzed by the microcontroller 301. The battery testing result is displayed on the LCD panel 303 of FIG. 3, 932 of FIG. 11, signaled by a LED indicator or announced by the speaker 305 of FIG. 3 or 934 of FIG. 11. FIG. 1, FIG. 10 and FIG. 11 demonstrate different structures to attach the contact terminals to the human finger. All other variations of the designs enabling the movement of the human fingers to control the position of two contact terminals, are included in the scope of the disclosure and claims of this patent application. In an alternate embodiment, the motor circuitry of FIG. 7F may be installed inside the control compartment 931. The motor may be linked to a gear down mechanism and/or an artificial load, the running speed of the motor or the torque exerted by the motor indirectly expressing the power driving capability of the battery under test. Traditional methods of expressing torque and rotational speed can then be utilized to indicate the relative strength of the battery under test.

Figure 12:
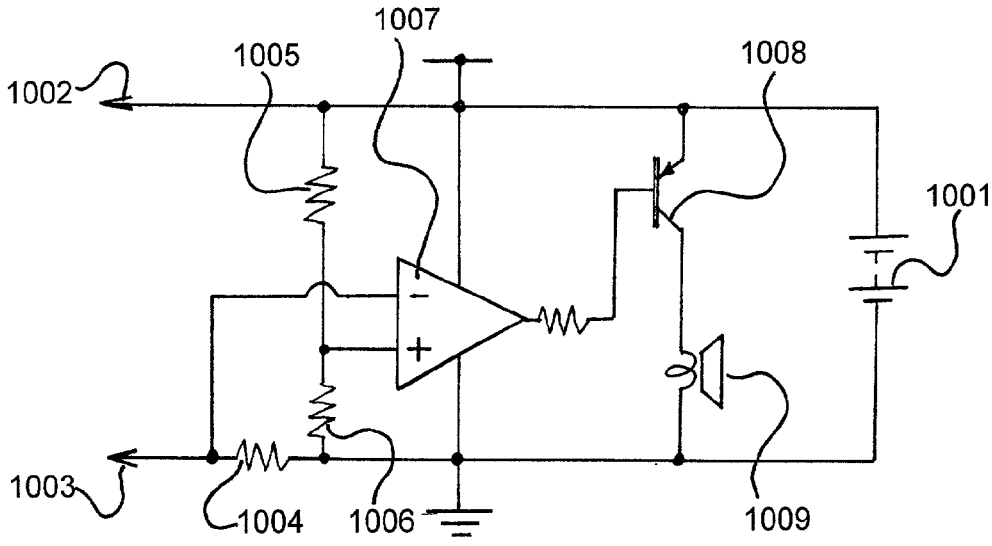
FIG. 12 is an embodiment that converts a pulse width modulation waveform represented by FIG. 4A and 4B for driving a speaker to produce an audio signal represented by the data stored inside an accessory toy member.

FIG. 12 is a simple version of FIG. 3 designed to pick up a pulse width modulated audio signal capable to drive a speaker. Assuming an accessory toy member is provided a pulse generation circuit as shown in FIG. 4A, and that the pulse generated shown in FIG. 4B is a pulse width modulated audio signal suitable for directly driving a speaker, the circuit shown in FIG. 12 represents a master toy member circuit capable of extracting the pulsing signal superimposed in the DC power supply as shown in FIG. 4B. The power source represented by the battery 1001 powered both the comparator 1007 and also the sound generating integrated circuit located inside the accessory toy member. The resistor 1004 defines the internal impedance of the power line as viewed by the electronics circuit located inside the accessory toy members. The impedance is required to superimpose the pulsing signal on top of the DC supply voltage. Resistors 1005 and 1006 form a reference potential divider for the comparator 1007. The reference voltage is set at a level just below the voltage level 425 as shown in FIG. 4B. Accordingly the comparator 1007 in response to the pulses 421, 422 of FIG. 4B, will turn the transistor 1008 on and off. The pulse width modulated audio signal will be converted into audible sound signals through the audio transducer represented by the speaker 1009.

Figure 13:
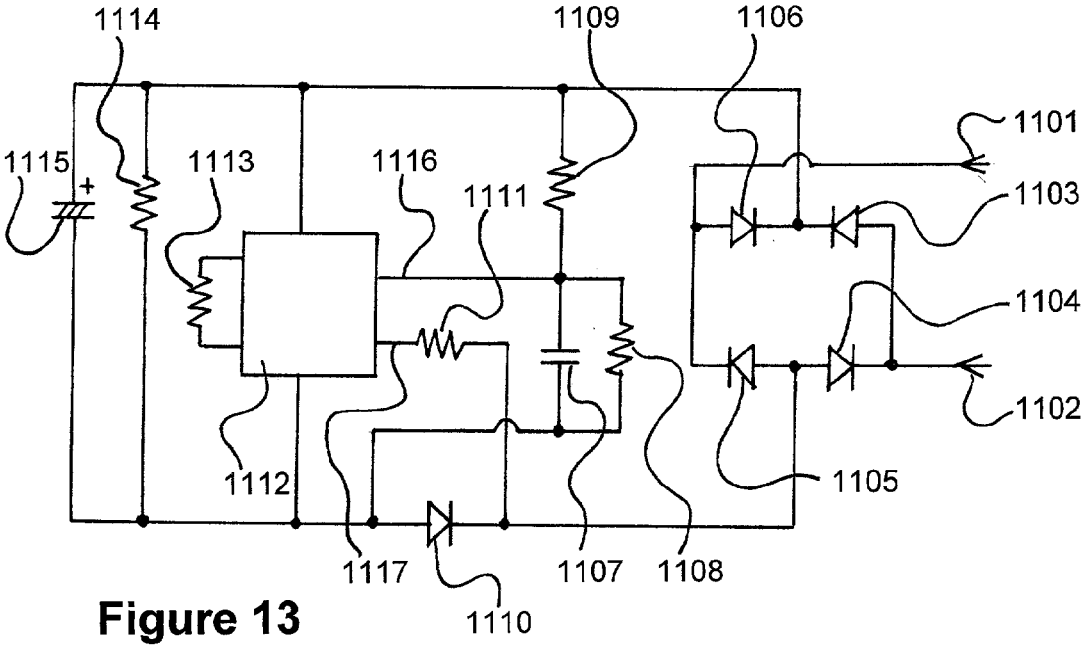
FIG. 13 represents a circuit built inside an accessory toy member to receive power in different polarities and to provide pulsing data back to the master toy unit through the power lines.

The sound generation circuit 400 as illustrated in FIG. 4A requires a voltage of proper polarity to connect with the contact terminals 408 and 409 in order for the circuit to function. The positive power line is required to be connected to the contact terminal 408. The ground power line should be connected to the contact terminals 409. In the situation of toy play set, it may be too demanding for the small kids to manage power connection with correct polarity. Accordingly it is desirable to provide a circuit capable to extract the pulsing signal from the power line no matter the power line is connected in the correct polarity direction or in the reverse polarity direction. FIG. 13 illustrates a preferred embodiment of a sound generating circuit located at the accessory toy side. Contact terminals 1101 and 1102 receive power from the master toy member in either polarity. The diodes 1106 and 1104 are conducting when the terminal 1101 is positive relative to the contact terminal 1102. Diodes 1103 and 1105 conduct when the voltage at terminal 1102 is positive relative to the contact terminal 1101. The polarity correction circuit can be provided inside an integrated circuit or by discrete components locate outside the integrated circuit. The feeding power charge up the capacitor 1115 which provides a small energy to maintain proper function of the sound generating integrated circuit 1112 when the power supply is momentary interrupted. Resistor 1114 discharges the energy stored inside the capacitor 1115 when the external power is removed. The oscillator resistor 1113 determines the clock frequency of the voice generation integrated circuit 1112. The data stores inside the integrated circuit 1112 represent a voice. The voice generating integrated circuit 1112 generates pulse width modulated pulses that are suitable to drive a speaker. The pulse width modulated signal is transmitted through the output pin 1117 and sinks supply line current through the resistor 1111. The value of the resistor 1111 as compared with the internal impedance of the master toy member circuitry forms a potential divider that defines the amplitude of the pulsing signal superimposed on the DC level as shown FIG. 4B. The diode isolates the power supply smoothing circuit formed by the capacitor 1115 from being interrupted by the pulsing signal driven by the output line 1117. Resistor 1109 and capacitor 1107 forms a delay trigger circuit or reset circuit that enables the integrated circuit 1112 to be activated at a short delay after the external power is received. At power up, the delay trigger circuit prohibits the integrated circuit to be triggered until it is stabilized.

Figure 14:
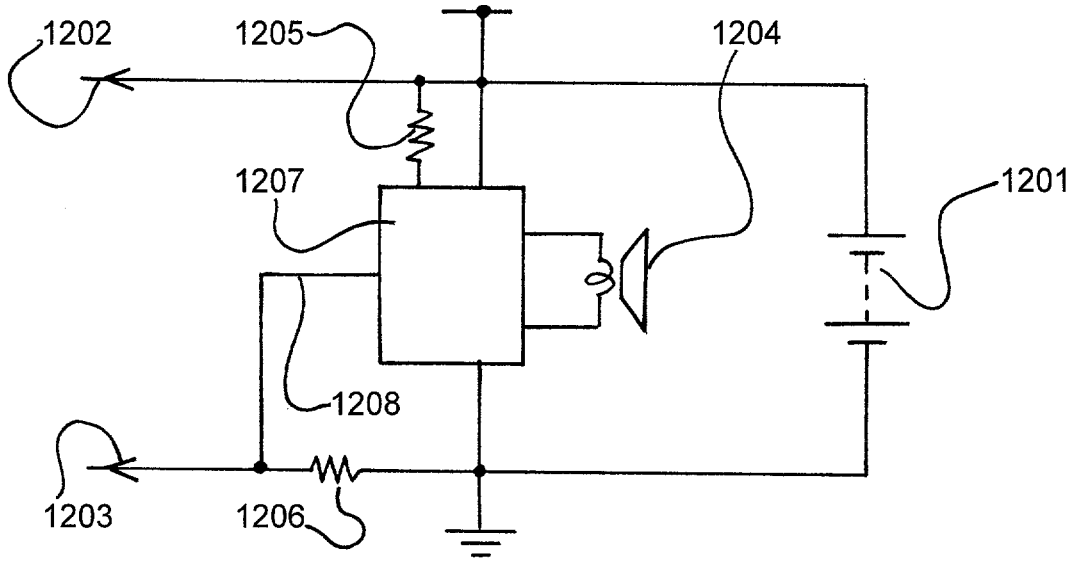
FIG. 14 illustrates a new integrated circuit designed for a master toy unit, that is configured to derive pulsing signals from the power line and to drive the speaker in both polarities.

It should be noted that the pulse width modulated output, although capable to drive the speaker directly as shown in FIG. 12, drives the speaker only in one direction. This arrangement does not make use of the full dynamic range of the speaker and therefore is inefficient to deliver loud sound volume. The optimal high efficiency audio arrangement is to drive the speaker 1009 in both directions. FIG. 14 illustrates an integrated circuit custom designed according to the subject invention to extract audio signals from the power line and to directly drive the speaker 1204 in both directions. In this arrangement the pulsing signal illustrated in FIG. 4B can no longer be pulse width modulated signal used for directly driving a speaker. Instead the pulsing signal generated is preferred to be pulse code modulated (PCM) signal that include a sign bit to tell the polarity of the speaker driving current. This PCM pulses are converted by the integrated circuit 1207 into pulse width modulated signals to drive the speaker 1204 in both directions. Similar to the resistor 1004 in FIG. 12, resistor 1206 defines the internal impedance of the master toy power supply circuit when viewed from the contact terminals 1202 and 1203. The pulses received from the power line is extracted by the integrated circuit 1207 according to the predefined input threshold of the input pin 1208.

Figure 16:
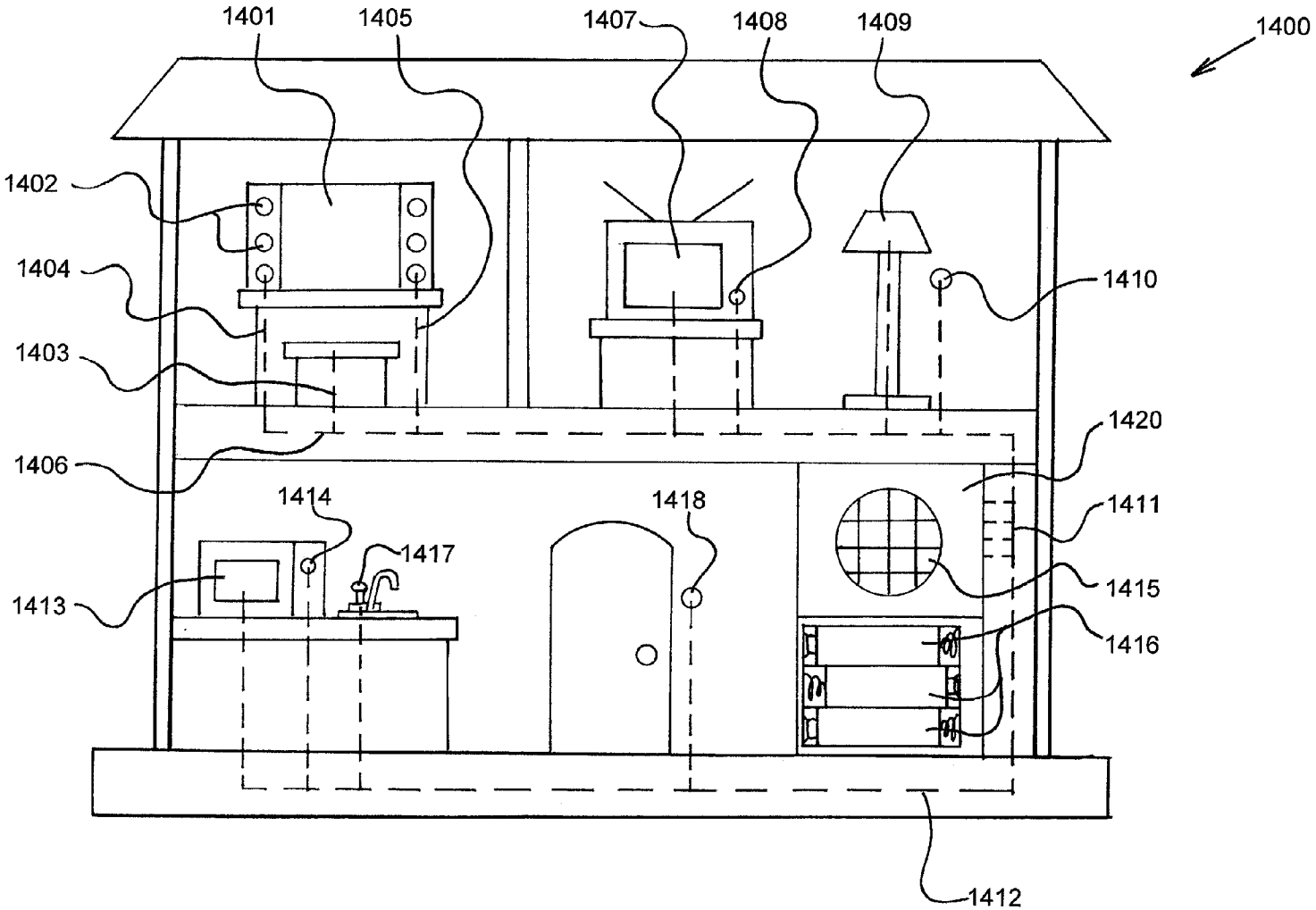
Figure 16 Prior Art
FIG. 16 shows a prior art dollhouse having furniture and facilities fixed in position and connected to a centralized controller circuit board, power source and speaker.

FIG. 16 illustrates a prior art interactive electronics dollhouse to represent a toy play set unit. At the lower level of the dollhouse is a trigger switch 1418, which represents a doorbell. When the switch 1418 is pressed, the trigger signal is sent to a centralized electronics module located behind the housing 1420 and then the doorbell sound is produced through the speaker 1415. Another trigger switch 1414 connected through the wiring 1412 to the centralized electronics module triggers the module to produce a microwave hissing sound. At the same time, a controller located in the centralized electronics module turns on the light and the motor inside the microwave oven 1413 through the wiring 1412.

At the upper level of the prior art dollhouse is a make up desk 1401 that comes with lights 1402. When the chair 1403 is pressed, a switch located underneath the chair sends a trigger signal to the centralized electronics module that turns on the lights 1402 through he wiring 1406, 1405 and 1404. 1407 is a TV set that is "turned on" by the switch 1408 to produce TV program sounds. The switch 1410 turns on and off the light bulb located behind the lamp 1409. It can be observed that the accessory toy members such as the microwave oven 1413, the faucet 1417, the doll bell 1418, the make up desk 1401, the TV 1407 and also the lamp 1409 are to be wired to an electronics module behind the housing 1420. This electronics module is powered by a fixed position power source 1416 and drives a fix position speaker 1415. The design of this traditional prior art dollhouse has several limitations as compared with the current invention. Firstly, excessive wiring to connect the accessory toy members to a centralized electronics module limits the design flexibility to structure the toy. Secondly, excessive wiring also causes more quality problems to the product. Thirdly, the accessory toy members are to be positioned at fixed locations that limited the play pattern for the kids.

Figure 17:
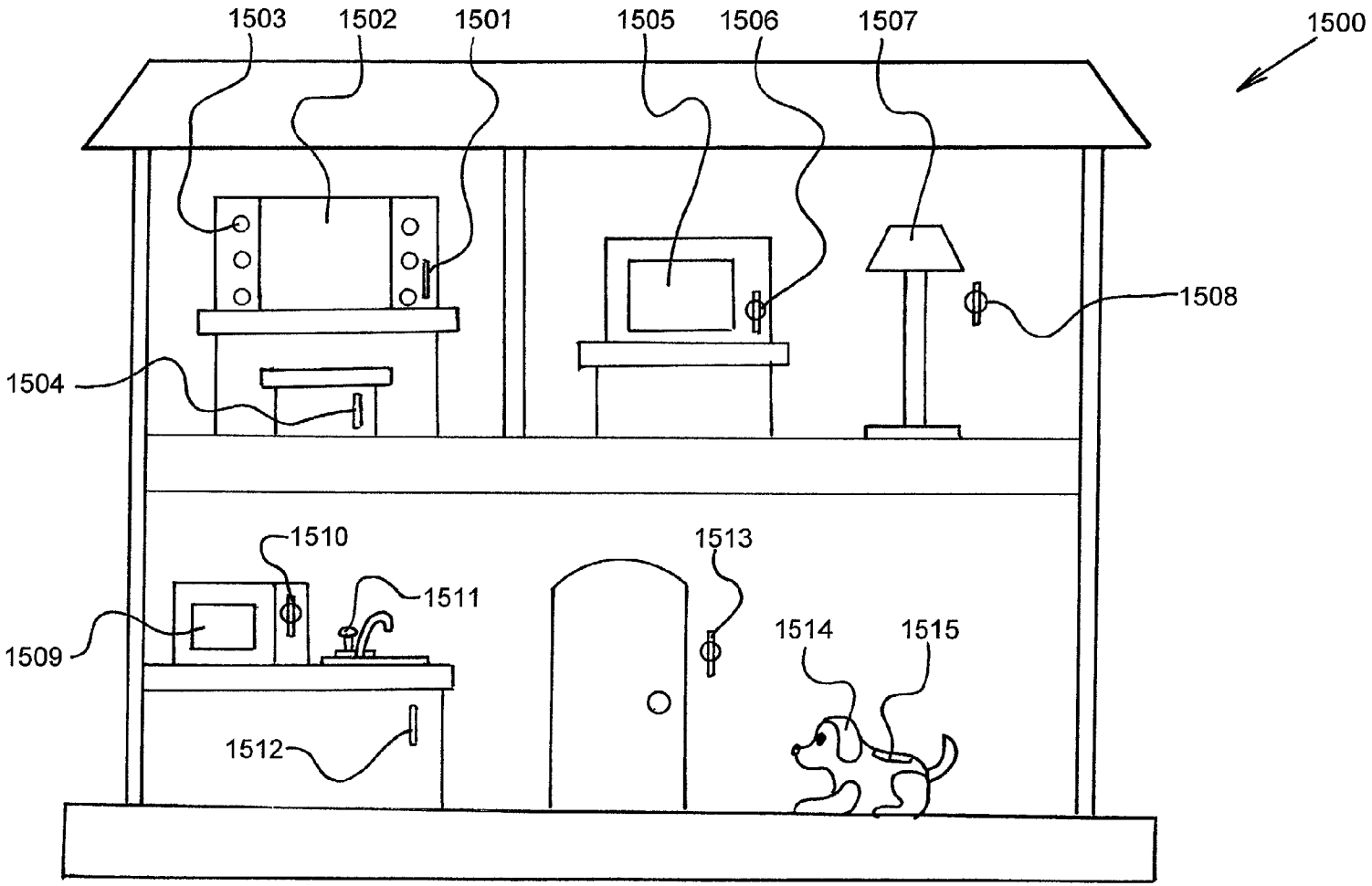
FIG. 17 illustrates an improved dollhouse to provide more flexibility, higher quality and greater play value.

FIG. 17 illustrates a dolls house modified according to the invented technology. The doorbell comprises a miniature circuit module as illustrated by the design shown in FIG. 4A for generating a doorbell sound when external power is received. This module is located right behind the doorbell contact terminals 1513. When the master doll characterized by an internal battery and a speaker is moved to access the contact terminals 1510, the doorbell circuit is activated. Doorbell sound is then generated through the doll. The microwave oven 1509 is provided another miniature module located behind the contact terminals 1510. A light bulb is also provided behind the door of the microwave 1509. 1512 represents the trigger terminals to turn on water running sound for the facet 1511. 1514 represents an interactive pet, another popular accessory toy member of a doll play set. The electronics module located inside the dog generates barking sound when power is supplied to the contact slot 1515. At the upper level of the dollhouse, the trigger contact 1504 initiates a conversation about vanity and make up stories through a small electronics module located beneath the chair. The contact terminals 1501 is connected to turn on the lights 1503. Inside the TV 1505 is another miniature sound module that receives power from the contact terminals 1506. When power is supplied to the contact terminals 1508, the lamp 1507 is turned on. In order to supply power to all these different local miniature electronics modules, the master doll is structured to provide at least two contact terminals. These contact terminals can be provide at any convenient location of the doll, including a podium located beneath the doll.

Figure 15A:
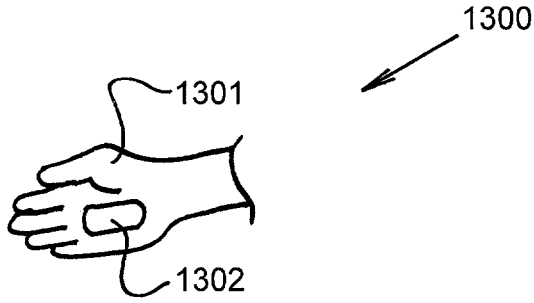
FIG. 15A illustrates the palm side of a doll's hand for touching and powering an accessory toy member.
Figure 15B:
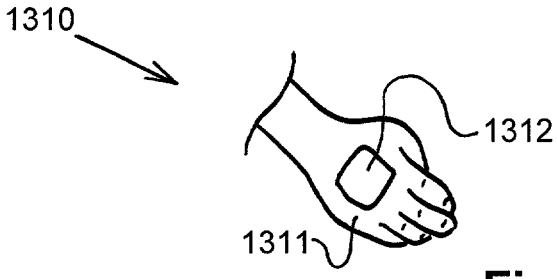
FIG. 15B illustrates the rear side of the doll's hand of FIG. 15A.

Attention is now drawn to FIG. 15A, which illustrates the palm side of a hand of the doll. A conductor terminal 1302 serves as the first contact terminal 1202 of FIG. 14 or contact terminal 310 of FIG. 3. At the rear side of the doll's hand 1310 as illustrated in FIG. 15B is another conductor pad 1312 that represents the other contact terminals of the circuit illustrated in FIG. 14 or FIG. 3. The master doll is equipped with internal power source such as batteries to power all the accessory toy members. A speaker and an electronics module are also provided inside the doll to extract the sound represented by the data stored inside the individual accessory toy members. When the hand of the doll is inserted into either one of the slots 1510, 1512, 1515, 1508, 1506, 1501 and 1504 of the play set accessories, a different response represented by a personalized sound, a lighting or an animated motion is provided. It should be noted that most of the interactive furniture inside the new dollhouse are now free to move around according to the wish of the kids. No long wiring that causes quality issues is required. It should also be noted that a movable interactive pet previous unavailable for the prior art doll play set of FIG. 16 is now possible. The interactive dog can be placed at any location inside the dollhouse.

Figure 18A:
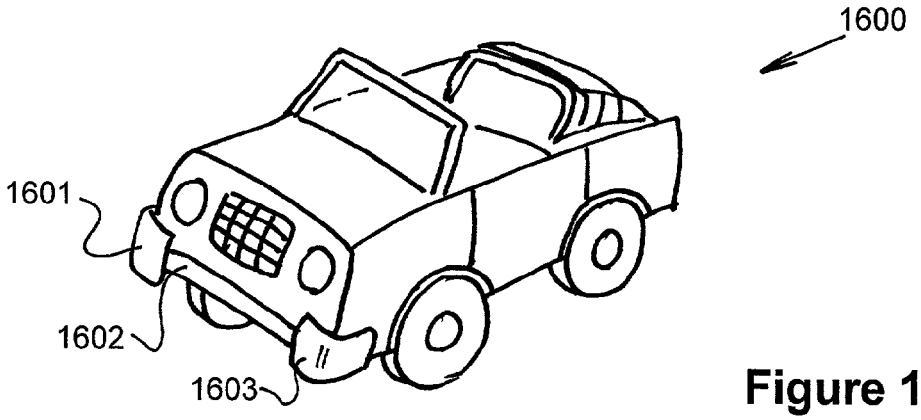
FIG. 18A illustrates a miniature toy vehicle that represents the master toy unit.
Figure 18B:
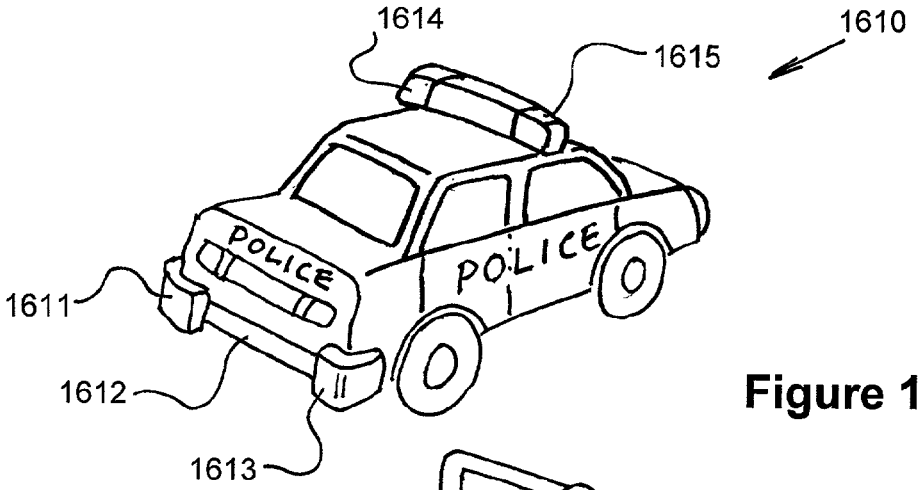
FIG. 18B illustrates a miniature toy vehicle that represents an accessory toy member.
Figure 18C:
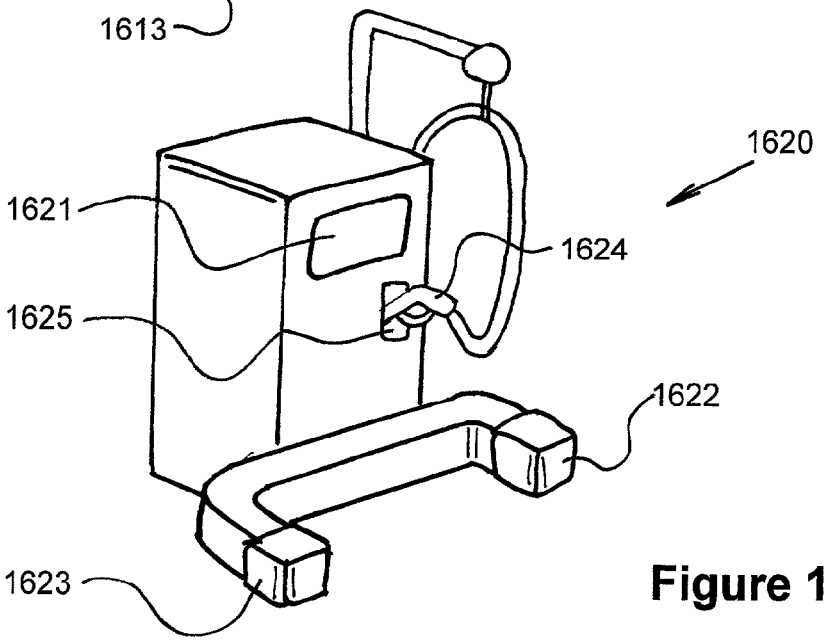
FIG. 18C illustrates a miniature building structure of a micro city that represents an accessory toy member.

Instead of a doll play set for girls the invention is also applicable for the boys to build a micro city play set having vehicles, buildings and other structures. Prior art vehicle play sets make use of the similar technology as illustrated in the prior art dollhouse demonstrated in FIG. 16. All supporting accessory fixtures and buildings are fixedly located on the play set. Accordingly the play set is bulky and difficult to be carried around. FIGS. 18A to 18C illustrates different discrete micro city building blocks to be arranged by the kids on the game floor of the micro city. FIG. 18A illustrates a vehicle that represents a master toy member. Similar to the master doll, power sources, speakers and audio extracting circuit is provided inside the master toy member. The two conductive corners 1601 and 1603 of the bumper 1602 represents the conductive contact members of the circuits illustrated in FIG. 3, FIG. 12 and FIG. 14. FIG. 18B illustrated another vehicle configured to be an accessory toy member. Inside the police car of FIG. 18B is the miniature electronics module of FIG. 4A, FIG. 4C, FIG. 5A or FIG. 13. The contact terminals of the circuit are represented by the conductive corners 1611 and 1613 of the bumper 1612. When the bumper of the vehicle 1600 is in contact with the bumper of the vehicle 1602, which are both aligned about the same height from the game floor, a police car siren sound is generated. Another miniature electronics module that provides gas pump sound effect and a panel light is provided inside the gas station 1620 of FIG. 18C. When the bumper 1602 of the vehicle 1600 during a moment of game play riding in the micro city is in contact with the conductive terminals 1622, 1623 of the gas station 1620, which are both aligned about the same height from the game floor, the display 1621 is lighted up and the gas pump sound effect is, generated when the gas pump nozzle 1624 is removed from the slot 1625. The benefits of this new toy set design is that the kids can collect different interactive accessory toy members one by one, as they are not fixedly structured on one play set unit. The toy set is more portable as compared with traditional micro city play set. In addition, all micro city accessory toy members can be repositioned according to the city planning designed by the kid on the game floor. It can be observed that all different toy members, including the master toy member and each accessory toy member has a different shape and personality. The response produced by different accessory toy members can be represented by different sounds, lightings and animated visual effects designed according to different personality of the accessory toy members.

A significant characteristic of the toy play set is that some accessory toy member is designed to provide only an audio response while another accessory toy member is characterized by providing only a visual response. It is also possible for another accessory toy member to provide both kinds of responses. The personality of each accessory toy member is defined by it's unique shape or the unique response provided. The master toy member is therefore required to provide a structure and/or interfacing circuit suitable for initiating both kinds of responses.

From the foregoing, it should now be appreciated that the applicant has disclosed herein embodiments of a controller device or master toy member configured to power or interface an electrical powered article of sales, or a family of accessory toy members. It is intended that the article of sales or accessory toy members do not require internal battery as a power source. The electrical power needed by the target article or accessory toy member are derived from the controller compartment by finger contacts or from the master doll. Particularly, it should be noted that there are different variations of finger contact designs, different ways to attach a contact terminal to the finger of a human hand, different methods to mount the control compartment to the body of the user and different natural ways to connect a master toy member with a collection of accessory toy members by contact terminals, for energizing different audio, light or motion responses according to the different personality of the accessory toys. Although detailed embodiments of the invention have been disclosed, it is recognized that variations and modifications, all within the spirit of the invention, will occur to those skilled in the art. It is accordingly intended that all such variations and modifications be encompassed by the appended claims.

I claim:

1. A method of playing with a toy play set comprises the steps of:

(1) providing a body, a sound transducer, a power source and at least first and second conductive contacts to a master toy member;

(2) providing a first circuit means and at least two conductive contacts to a first accessory toy member for receiving power from said master toy member and for said first accessory toy member to provide a mechanical or visual response effect; wherein the conductive contacts of said first accessory toy member are positioned to make contact with the conductive contacts of said master toy member;

(3) providing a second circuit means and at least two conductive contacts to a second accessory toy member for receiving power from said master toy member and for said master toy member to generate a sound according to data provided by said second circuit means; wherein the conductive contacts of said second accessory toy member are positioned to make contact with said conductive contacts of said master toy member;

(4) moving the body of said master toy member for said at least first and second conductive contacts to make contact with the conductive contacts of said first accessory toy member for providing power to said first accessory toy member and for said first accessory toy member to produce the mechanical or visual effect of step (2);

(5) moving the body of said master toy member for it's conductive contacts to make contact with the conductive contacts of said second accessory toy member for providing power to said second accessory toy member to generate the sound of step (3).

2. The method of claim 1 wherein said accessory toy members are positioned at different fixed locations of a toy play set unit.

3. The method of claim 1 wherein said first accessory toy member comprises a visual transducer to convert electric current into visual effect.

4. The method of claim 1 wherein said first accessory toy member is characterized by a visual response and said second accessory toy member is characterized by an audio response.

5. The method of claim 1 wherein each of said first and second accessory toy members has a different shape to define a different personality for each of said corresponding first and second accessory toy members.

6. The method of claim 5 wherein each of said accessory toy members provides a different response defined by the different personalities of said accessory toy members.

7. The method of claim 1 wherein said master toy member is a doll.

8. The method of claim 7 wherein each of said accessory toy members triggers a different audio or visual response when making contact with said doll.

9. The method of claim 1 wherein said first accessory toy member represents a miniature transportation vehicle.

10. The method of claim 1 wherein the circuit means of one of said accessory toy members is configured to work only at a first predefined voltage polarity;

said accessory toy member further comprises a supplemental electronics circuit without a relay; said supplemental electronics circuit is configured to enable said circuit means to function properly when the conductive contacts of said master toy member make contact with the conductive contacts of said accessory toy member either in a first polarity direction or in a second opposite polarity direction.

11. The method of claim 1 wherein said first conductive contact is positioned by the motion of a first finger of a user and said second conductive contact is positioned by the motion of a second finger of said user.

12. The method of claim 1 wherein the generation of sound by said master toy member is initiated when the conductive contacts of said master toy member are in contact with the conductive contacts of said second accessory toy member.

13. The method of claim 12 wherein said master toy member comprises a driving circuit to drive said sound transducer in a first polarity direction and a second opposite polarity direction.

14. The method of claim 1 further comprising a step to provide a short circuit sensor or a current limiter to limit or cut the current drawing from said master toy member when said first and second conductive contacts of said master toy member are short circuited with each other.

15. A toy play set comprising:

a master toy member having a sound transducer, a power source and at least two conductive contacts for providing power from said power source to an external accessory toy member;

a first accessory toy member having at least two conductive contacts and a circuit to provide mechanical or visual response when power is receive from the conductive contacts of said master toy member; and a second accessory toy member consists of two conductive contacts and an electronics circuit configured to receive power from the conductive contacts of said master toy member; wherein the two conductive contacts and electronics circuit of said second accessory toy member are further configured for providing an audio response through the sound transducer of said master toy member.

16. The toy play set of claim 15 wherein said audio response is provided when the conductive contacts of said master toy member are in touch with the two conductive contacts of said second accessory toy member.

17. A toy play set comprising a master toy member and at least a first accessory toy member; wherein said first accessory toy member having at least two conductive contacts is represented by an accessory building structure or an accessory transportation vehicle;

said master toy member is represented by a master transportation vehicle;

said first accessory toy member comprises memory storing data representing an audio signal;

said master toy member comprises a power source and at least two conductive contacts dimensioned and positioned to make electrical contact with said first accessory toy member for providing power to said first accessory toy member at a moment when said master transportation vehicle is driven to meet said first accessory toy member on a game floor; and said master toy member further comprises an audio transducer and a circuit for producing an audio sound represented by said data.

18. The toy play set of claim 17 wherein the conductive contacts of said first accessory toy member are positioned at predefined contact level or levels relative to the game floor and the conductive contacts of said master toy member are positioned to correspond to the contact level or levels of said first accessory toy member for said master transportation vehicle to make conductive contact and energize said first accessory toy member during a game play.

19. A toy play set comprising:

at least a first master toy member;

at least a first electronics circuit, a second electronics circuit provided internally to said first master toy member;

at least a first connector and a second connector provided internally to said first master toy member;

wherein said first electronics circuit is connected to said first connector and said second electronics circuit is connected to said second connector; and a slave toy member having a power source and a sound transducer; wherein a sound is generated from said sound transducer when said slave toy member is in contact with one of the connectors of said first master toy member and a mechanical or visual effect is generated by said toy play set when said slave toy member is in contact with another connector of said first master toy member.

20. The toy play set of claim 19 wherein said first master toy member comprises a motion transducer and a light transducer; and wherein said motion transducer and said light transducer are to be triggered by different connectors of said first master toy member.

21. The toy play set of claim 19 wherein said first electronics circuit is characterized by a motion transducer and said second electronics circuit is characterized by a sound defined by said second electronics circuit.

22. The toy play set of claim 19 wherein said first electronics circuit is characterized by a light transducer and said second electronics circuit is characterized by a sound defined by said second electronics circuit.

23. The toy play set of claim 19 wherein said first master toy member is a doll house.

24. The toy play set of claim 19 wherein said first electronics circuit comprises memory means storing data representing an audio signal; said slave toy member is configured to produce an audio sound represented by said data.

25. The toy play set of claim 24 wherein said slave toy member consists of two contact terminals.

26. The toy play set of claim 25 wherein the two contact terminals of said slave toy member can be connected without a relay with said first connector in a first polarity direction and a second reverse polarity direction to generate a sound.

27. The toy play set of claim 19 wherein said first master toy member is a building, and said building comprises pictures representing the different natures or personalities of said first and second electronics circuits.

28. The toy play set of claim 27 wherein said first and second connectors are fixedly located on different locations of said building.

29. The toy play set of claim 19 wherein at least one of said first and second connecters of said first master toy member comprises at least two contact terminals; said first master toy member further comprises a sensing circuit or current limiter to limit or to cut the current drawing from said power source when said two contact terminals are short circuited with each other.

30. A toy play set comprising a first integrated circuit and a second integrated circuit;

said first integrated circuit having data representing a first audio sound; said first integrated circuit is further configured to receive power from a first power line and a second power line; said first integrated circuit is also configured for sending an interfacing signal representing said first audio sound to said second integrated circuit through said first and second power lines; and said second integrated circuit is configured to receive the interfacing signal representing said first audio sound from said first integrated circuit through said first and second power lines; and said second integrated circuit is further configured to convert said interfacing signal for driving an audio transducer.

31. The toy play set of claim 30 wherein the interfacing signal transmitted through said first and second power lines comprises polarity information instructing said second integrated circuit to drive said audio transducer in a first polarity direction and a second opposite polarity direction.

32. The toy play set of claim 30 further providing a circuit configured for said first integrated circuit to receive power from said first and second power lines in a first polarity direction and a second opposite polarity direction.

33. The toy play set of claim 30 wherein said second integrated circuit is installed inside a master toy member having a power source and an audio transducer for producing the audio sound represented by the data of said first integrated circuit; and said first integrated circuit is installed inside a first accessory toy member characterized by said first audio sound.

34. The toy play set of claim 33 further comprising a third integrated circuit having data representing a second audio sound different from that of said first integrated circuit for characterizing the personality of a second accessory toy member.

35. The toy play set of claim 34 wherein said first and third integrated circuits are installed inside a unit of said toy play set, and said second integrated circuit is installed inside said master toy member separated from said toy play set unit.

36. The toy play set of claim 33 wherein each of said master toy member and said accessory toy member comprises a pair of conductor terminals for said master toy member to conduct power to said accessory toy member.

37. The toy play set of claim 36 wherein said interfacing signal is transmitted from said first integrated circuit to said second integrated circuit at a time delayed from the moment when said first integrated circuit receives power from said conductor terminals.

38. The toy play set of claim 35 wherein said toy play set unit is represented by a doll house and said master toy member is represented by a doll.

39. The toy play set of claim 19 further comprising a first integrated circuit and a second integrated circuit;

said first integrated circuit having data representing a first audio sound; said first integrated circuit is further configured to receive power from a first power line and a second power line; said first integrated circuit is also configured for sending an electrical signal representing said first audio sound to said second integrated circuit through said first and second power lines; and said second integrated circuit is configured to receive the interfacing signal representing said first audio sound from said first integrated circuit through said first and second power lines; and said second integrated circuit is further configured to convert said electrical signal suitable for driving an audio transducer.

40. The toy play set of claim 15 wherein said first and second accessory toy members are configured to work properly without a relay when the conductive contacts of said master toy member are connected with the conductive contacts of one of said first or second accessory toy member both in a first polarity or in a second opposite polarity; wherein a circuit provided in said accessory toy member connected is required to work with a specified voltage polarity.

* * * * *